US012004584B2

(12) United States Patent
Kwok et al.

(10) Patent No.: US 12,004,584 B2
(45) Date of Patent: Jun. 11, 2024

(54) PROTECTIVE HEADGEAR WITH INTEGRALLY-FORMED LAYER

(71) Applicant: ZAM Helmets Inc., Redwood City, CA (US)

(72) Inventors: Whitman Kwok, Emerald Hills, CA (US); David Stoutamire, Menlo Park, CA (US); Michael Lowe, Santa Cruz, CA (US)

(73) Assignee: ZAM Helmets Inc., Redwood City, CA (US)

( * ) Notice: Subject to any disclaimer, the term of this patent is extended or adjusted under 35 U.S.C. 154(b) by 191 days.

(21) Appl. No.: 16/671,770

(22) Filed: Nov. 1, 2019

(65) Prior Publication Data

US 2020/0138141 A1 May 7, 2020

Related U.S. Application Data

(60) Provisional application No. 62/823,115, filed on Mar. 25, 2019, provisional application No. 62/754,666, filed on Nov. 2, 2018.

(51) Int. Cl.
*A42B 3/06* (2006.01)
*A42B 3/04* (2006.01)
(Continued)

(52) U.S. Cl.
CPC ..... *A42B 3/063* (2013.01); *A42B 3/0486* (2013.01); *A42B 3/061* (2013.01); *A42B 3/125* (2013.01); *A42B 3/20* (2013.01)

(58) Field of Classification Search
CPC ..... A42B 3/063; A42B 3/064; A42B 3/30; A42B 3/20; B29C 44/348; Y10T 442/3341
(Continued)

(56) References Cited

U.S. PATENT DOCUMENTS 5,412,814 A 5/1995 Pernicka et al.
10,850,165 B2 * 12/2020 Nürnberg ..... A63B 45/00
(Continued)

FOREIGN PATENT DOCUMENTS

WO 2017136941 8/2017
WO 2020092952 5/2020

OTHER PUBLICATIONS

"International Application Serial No. PCT US2019 059464, International Preliminary Report on Patentability dated May 14, 2021", 17 pgs.

(Continued)

*Primary Examiner* — Timothy K Trieu
(74) *Attorney, Agent, or Firm* — Schwegman, Lundberg & Woessner, P.A.

(57) ABSTRACT

A helmet may be worn on a head of a wearer having a shape and a contour. The helmet may have a plurality of layers coupled together including an energy management layer and an outer shell layer disposed over the energy management layer. The plurality of layers are integrally formed with one another, and the energy management layer is configured to absorb and dissipate energy received by the helmet during an impact by an external force. The outer shell layer is configured to disperse and dissipate impact energy from the external force. Each of the plurality of layers has a density and a geometry, and the density or geometry of at least one layer differs from the density or geometry of at least another layer.

10 Claims, 30 Drawing Sheets

(51) Int. Cl.
*A42B 3/12* (2006.01)
*A42B 3/20* (2006.01)

(58) Field of Classification Search
USPC ..... 2/424
See application file for complete search history.

(56) References Cited

U.S. PATENT DOCUMENTS

| | | | | |
|---|---|---|---|---|
| 2004/0139531 | A1 | 7/2004 | Moore et al. | |
| 2006/0206976 | A1 | 9/2006 | Futch | |
| 2008/0066217 | A1* | 3/2008 | Depreitere | A42B 3/128 2/412 |
| 2009/0188022 | A1 | 7/2009 | Durocher et al. | |
| 2011/0138520 | A1 | 6/2011 | Deboer | |
| 2012/0017358 | A1* | 1/2012 | Princip | A42B 3/063 2/414 |
| 2012/0060251 | A1* | 3/2012 | Schimpf | A42B 3/064 2/5 |
| 2013/0025032 | A1 | 1/2013 | Durocher et al. | |
| 2013/0061375 | A1 | 3/2013 | Bologna et al. | |
| 2014/0201889 | A1 | 7/2014 | Pietrzak et al. | |
| 2015/0271367 | A1* | 9/2015 | Musec | A42B 3/20 348/376 |
| 2018/0206584 | A1 | 7/2018 | Allen et al. | |
| 2018/0280188 | A1 | 10/2018 | Littlefield et al. | |
| 2020/0100554 | A1 | 4/2020 | Bologna et al. | |

OTHER PUBLICATIONS

"International Application Serial No. PCT US2019 059464, International Search Report dated Jan. 24, 2020", 3 pgs.
"International Application Serial No. PCT US2019 059464, Written Opinion dated Jan. 24, 2020", 15 pgs.
"Expanded Polypropylene (EPP)", Expanded Polypropylene, [Online] Retrieved from the internet:https: www.bpf.co.uk plastipedia polymers Expanded_Polypropylene_EPP.aspx, (2019), 2 pgs.
"Overview of materials for PVC, Foam Grade", Overview of materials for PVC, [Online] Retrieved from the internet: http: www.matweb.com search DataSheet.aspx?MatGUID=e19bc7065d 1 c4836a89d41 ff23d47413., (2019), 3 pgs.

* cited by examiner

View A-A

PROTECTIVE HEADGEAR WITH INTEGRALLY-FORMED LAYER

CLAIM OF PRIORITY

The present application is a non-provisional of, and claims the benefit of US Provisional Patent Application Nos. 62/823,115 filed Mar. 25, 2019; and 62/754,666 filed Nov. 2, 2018; the entire contents of which are incorporated herein by references.

BACKGROUND

Headgear such as helmets are worn in many situations in order to protect the wearer's head as well as to provide a base on which accessory items may be attached such as cameras or lights. Headgear dissipates energy received by the head during an impact thereby helping to minimize or avoid damage to the skin, bone, brain, and other adjacent tissues. The vast majority of helmets utilize injection molded outer shells with a foam lining, which may be uncomfortable to the user and be less than optimal for energy dissipation due to tooling costs and the mechanical properties of existing foam-based materials. It would be desirable to provide improved helmets.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Commercially available headgear provides protection to the wearer's head and adjacent tissue by dissipating and attenuating energy received during an impact or other force to the head. Because headgear such as helmets are often manufactured using injection molding processes, they are often made to standard sizes and shapes which may not be optimally fitted to the wearer's head. This can lead to discomfort and in certain situations less optimal protection to the head particularly if the user chooses to select a helmet that fits loosely to minimize pressure points. Moreover, headgear often employ standard foams or other materials to help assist with the energy dissipation and these materials and their geometries may also be less than optimal for dissipating impact energy to the head.

These helmets often also utilize separate fasteners (such as a threaded bolt) attached to the headgear to help attach other items such as cages, straps or other accessory items such as lights or cameras to the helmet. The fasteners can fail due to rust or they can create impact points prone to failure. Therefore, there is a need for improved headgear and at least some of these challenges may be addressed by the examples of headgear disclosed herein.

A number of examples of helmets with and features are disclosed herein. One of skill in the art will appreciate that any of the features may be used alone or in combination with one or more of the other features in any helmet.

Integrated hardware (e.g. clips) and novel energy absorbing structures are created using additive manufacturing techniques such as those described herein. Integrated hardware makes the helmet lighter and easier to use, specifically in securing and removing the cage or having other functions.

In addition, a redesigned low-profile cage reduces visual interference from the bars of the cage, reduces the probability of cage locking with other cages or other protrusions and also may reduce the amount of torque delivered to the head in the case of an impact. These and other features are disclosed herein.

While the examples disclosed herein are primarily directed at headgear used during hockey games, one of skill in the art will appreciate that this is not intended to be limiting and the headgear features disclosed herein may be used in any number of other sports, work, combat operations or first responder activities, or other activities where headgear is used to protect the head or even used in other protective equipment used to protect other parts of the body.

Terms

Figure 39:
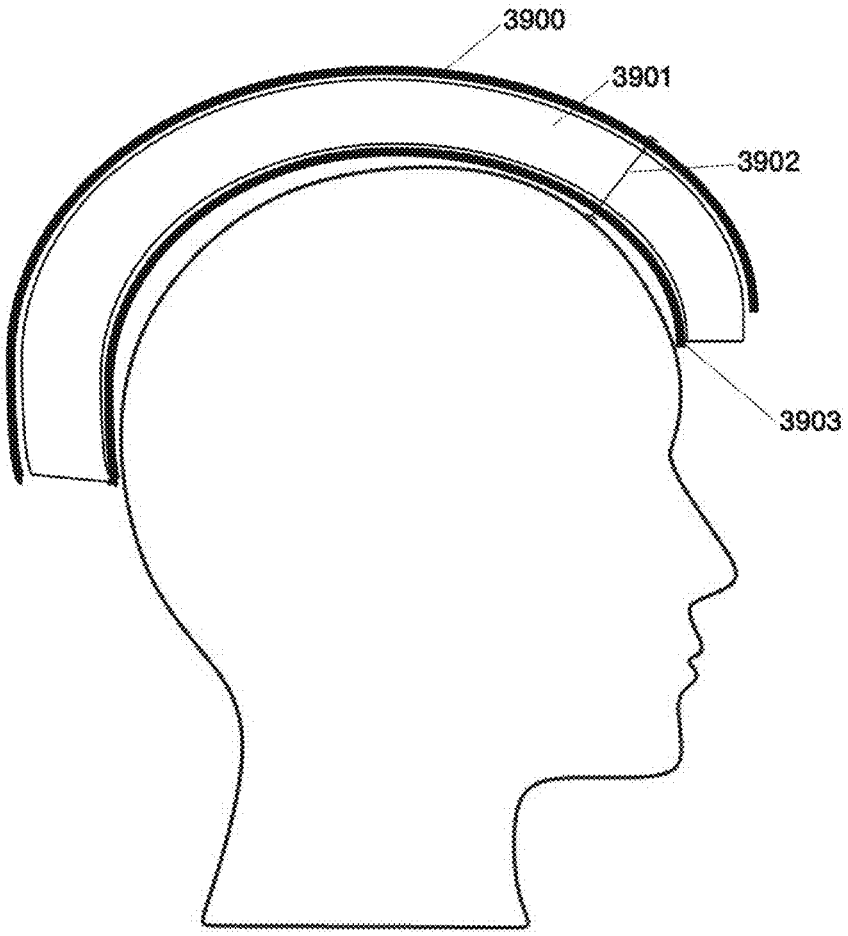
FIG. 39 shows the basic components in a typical helmet.

The following are commonly used terms to describe the components of a traditional helmet. Some of the proposed examples consolidate the functions of one or more of these areas into a single component. FIG. 39 illustrates basic components of a helmet which includes the outermost layer of the helmet which is a shell, an energy management layer, an optional accessory visor (not illustrated), and optional comfort layer.

Helmet—any form of protective headgear covering all or some portion of the head with the intent of reducing injury to the wearer or providing a support for equipment such as a light or camera.

Shell—the outermost portion of the helmet, traditionally made of a hard plastic to disperse impact energies over a broader surface to prevent skull fractures or localized bruising. It may also serve the additional purpose of adding durability and protecting the more fragile energy management layer.

Energy Management Layer—sometimes referred to as the protective padding, comprises the bulk of the offset of the helmet from the head.

Cage Clips—hardware, plastic, metal or any other material known in the art, that attach a cage to a helmet.

Cage Straps—nylon, polypropylene, polyester, cotton or any other material known in the art, forming straps that affix the cage to the helmet.

Comfort Liner—an optional liner, typically much softer than either the shell or energy management layer to facilitate fit and comfort for the wearer.

J-Clip—hardware, typically plastic but may be any other material known in the art, in the shape of an upside down J when viewed from the front of a helmet. May be fastened to the helmet with one or more screws.

Offset—the normal (measured orthogonally) distance between the head form and the outermost portion of the shell at any given point. May also be referred to herein also as stand-off.

Hardware—in the context of helmets, refers to any bolts, screws, nuts, washers, fasteners, clips, fixtures, supports or other ancillary components, commonly plastic and/or metal, whose primary purpose is for the assembly of the helmet and/or the attachment of accessories to the helmet.

Figure 1A:
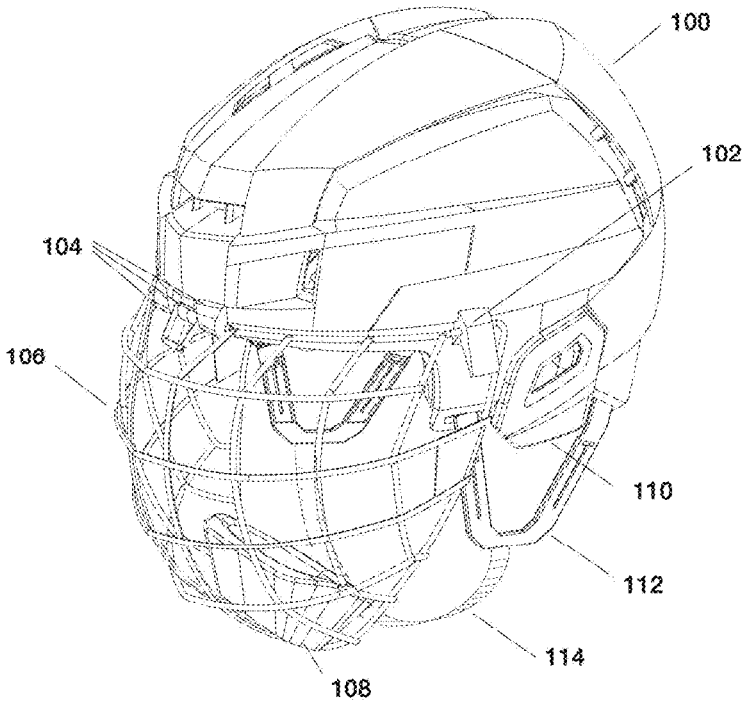
FIG. 1A shows a perspective view of a helmet and associated accessories.
Figure 1B:
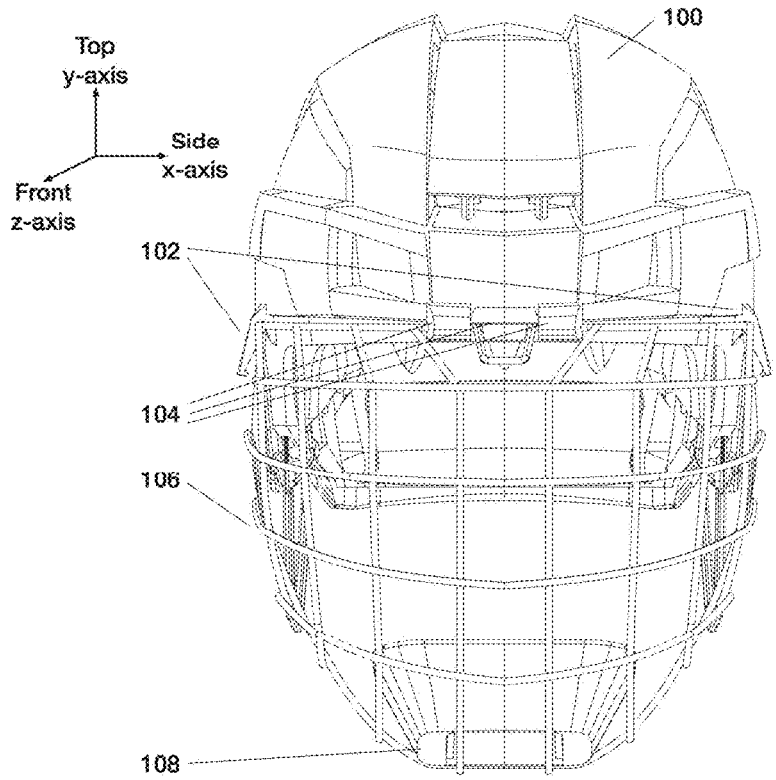
FIG. 1B shows a front view of the helmet in FIG. 1A.
Figure 1C:
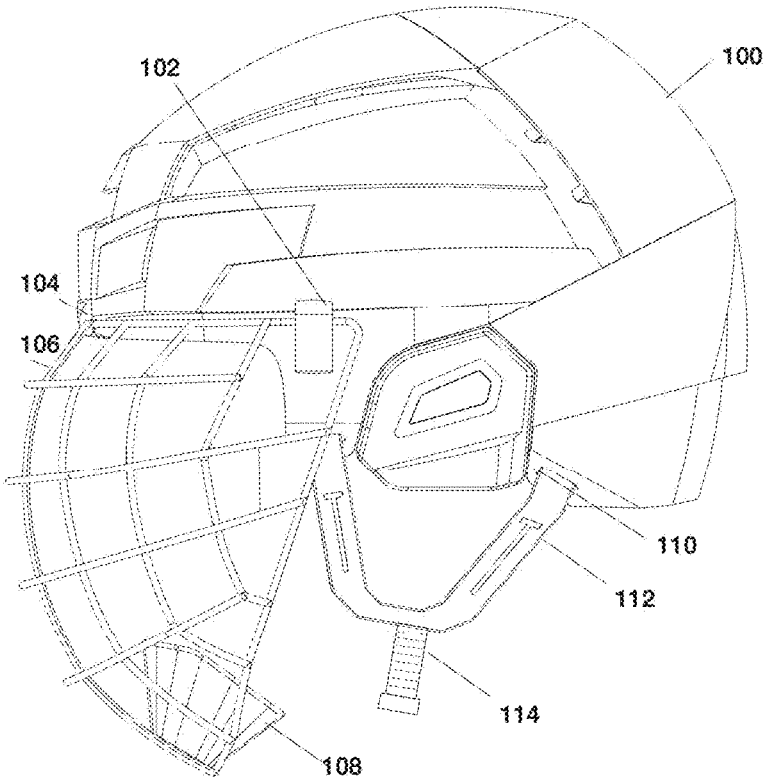
FIG. 1C shows a side view of the helmet in FIG. 1A.

One example of the headgear is a helmet and cage for hockey illustrated in FIGS. 1A-IC. FIG. 1A shows a perspective view, while FIG. 1B shows a front view and FIG. 1C shows a side view of an example of a helmet having a at least some of the features disclosed herein and any of these features may be optionally used in any helmet individually or in combination with any of the other features disclosed herein. The helmet 100 covers the head (not shown). Quick clips 102 on each side of the helmet adjacent the temples and front clips 104 adjacent the forehead receive a bar on the cage and attach the cage 106 to the helmet. The cage comprises a plurality filaments (also referred to as wires) connected together at nodes, including horizontally oriented filaments and vertically oriented filaments. Attached to the cage is a chin cup 108 that stabilizes the cage and helmet on the user's head by providing support from the chin. Ear cups 110 protect the user from hockey sticks or other player's skates. Ear loops having a U-shaped strap with an open center region for the ear, on each side of the helmet 112 and a chin strap 114 with an adjustable strap locking feature further secure the helmet to the user's head.

FIG. 1B also has a coordinate system to specify the axis and relative directions (front, side and top) referenced in this specification. Additional details about the features in helmet 100 are disclosed below. Each feature is described in separate sections, and one of skill in the art will appreciate that any feature may be utilized individually in a helmet, or any combination of the features disclosed herein may be used in a helmet.

FIG. 1C shows the helmet of FIG. 1A in a side view.

Angular Acceleration Reduction

Reducing angular accelerations on the head is generally accepted as a way of reducing concussions experienced by the user. Use of certain materials, manufacturing processes and/or application of surface features and treatments to any of the examples of helmets disclosed herein may facilitate rotation of the helmet relative to an impact surface without rotating the head, thereby reducing the probability of a concussion. Any of these features may be used alone or in combination with one or more of the other features disclosed herein.

Low Profile Cage

Another example of reducing angular acceleration is by controlling the size of the helmet. Hockey cages typically protrude out significantly from the face to avoid high velocity pucks from making contact with the face during an impact. A large offset between the cage and the face is required as the cage has substantial play between the J-clips, loose chin straps and a generously sized chin cup. The wires form a tight knit mesh to prevent contact to the face from another player's stick.

Optionally, it may be desirable to provide a lower profile cage as this can reduce torque experienced by the helmet and the wearer's head during impacts as well as providing improved visibility through the cage. Any of the features associated with low profile cages may be included with any of the other helmet features disclosed herein, in any example of a helmet.

A slim profile cage is made possible by including an integrated cage mount and helmet design that positions the cage closer to the head. The lower profile cage positions the cage wires closer to the face, and a slim chin cup that requires less distance between the wire cage and chin than traditional helmets may also be used. Higher precision manufacturing tolerances and hardware that does not require excessive offsets to compensate for flex and undesirable positioning also help provide a low-profile cage. Optionally using one or more of these features in a helmet results in a predictable amount of flex, lower torque from oblique impacts, all while keeping the cage away from the player's face. In addition, the vertical wires of the cage are woven through the inside of the cage and one or both ends of the vertical wires are welded on an outer surface of the cage (e.g. to an outer surface of a horizontal wire), and the other vertical wires are welded on an outer surface of the cage to the horizontal wires, as opposed to the vertical wires being on the outside with welds on the inside, while horizontal wires are on the outside of the cage. Having the vertical wires on the inside prevents the cage from catching another player's cage in a head to head collision and minimizes or reduces the resultant rotational acceleration along the axis of the neck. Welds on the outside may help prevent weld failure from failing and pushing the wires inward toward the face and eyes. Having the end of the wires terminate on the outside of the cage at the top and bottom of the cage acts as an additional precaution should a weld fail. Specifically, the wire will elongate away from the head, rather than towards it. Also, a desirable by product of the low-profile cage is better visibility from fewer wires blocking the field of view and the cage wires in view being closer to the face and eyes and therefore further out of focus reducing obstruction.

Figure 2A:
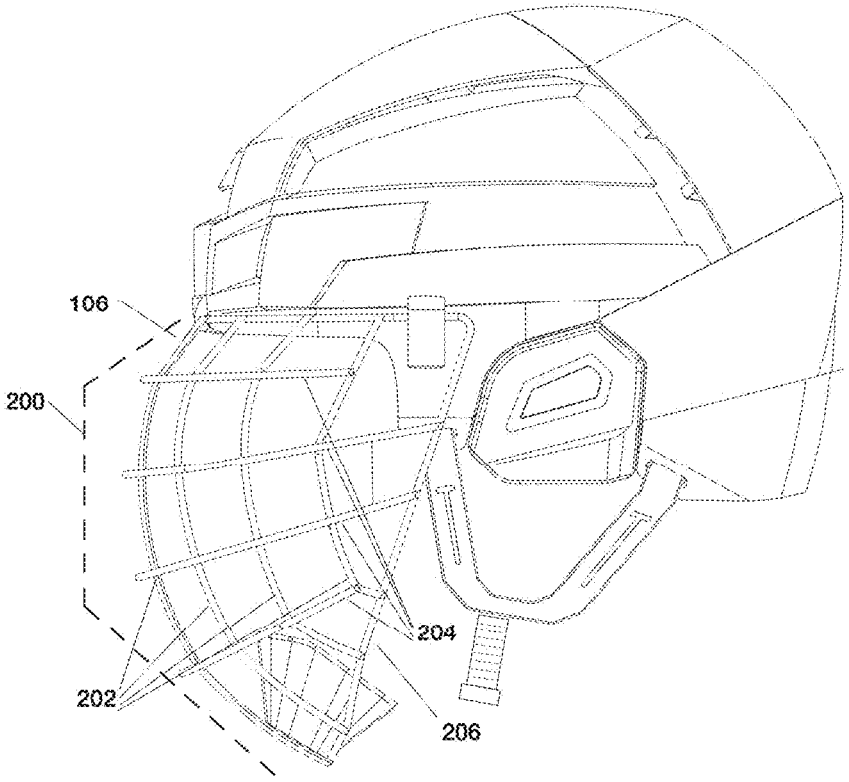
FIG. 2A shows a side view of a low-profile hockey cage mounted to a helmet compared to a standard cage mounted to the helmet.
Figure 2B:
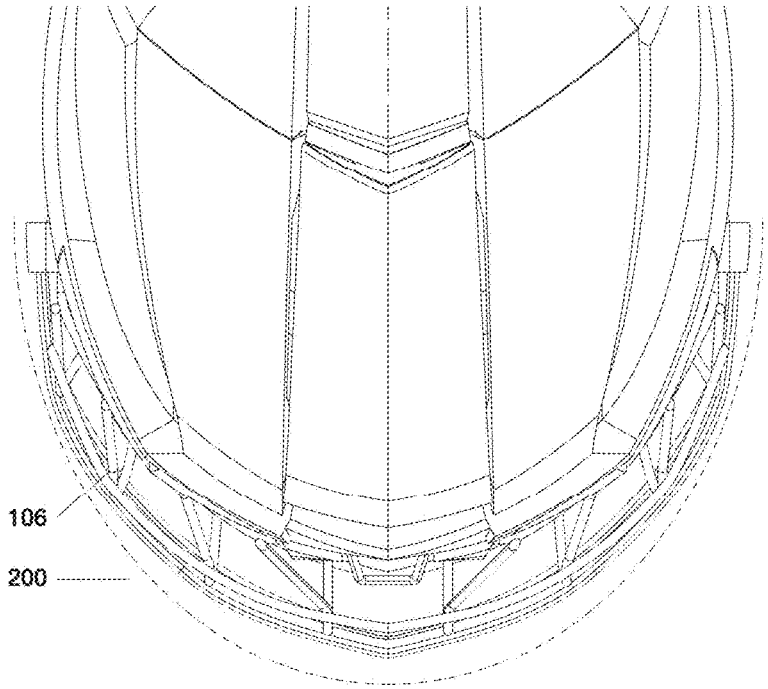
FIG. 2B shows a top view of the helmet in FIG. 2A.

FIGS. 2A and 2B illustrate how a low-profile cage 106 reduces the distance from the player's head relative to a standard cage 200 shown in phantom and thereby reducing the torque during contact. The cage can be anywhere from 5-50 mm or even 5-25 mm closer to the player's face. The furthest point on the cage from the nose may be 20-35 mm. In order to prevent the cage making contact with the player's face with the reduced offset, examples of the helmet may use a combination of 2.8 mm or greater diameter metal wire for stiffness. However, the cage can utilize other materials, diameters, and cross sections of wires. Furthermore, the cage minimizes the use of low radius bends that deform under load in favor of higher radius bends and may also include the use of arches.

As previously discussed, to further minimize the torque on the wearer's head, the vertical wires 202 are placed on the inside of cage rather than the horizontal wires 204 to prevent the cage from catching an opposing cage. The wire ends are welded to the perimeter wire 206 and thus the wire ends of the vertical wires are disposed on an outer surface of the cage.

The cage is otherwise operated like a typical hockey cage. The cage is attached to the helmet via clips and the chin cup is mated to, or within 20 mm of the user's chin.

Helmet examples that comprise a cage with a smaller offset improve safety by reducing torque to the head and the accompanying rotational energies by 5-25%, proportional to the reduction in the lever arm. The distance measured on the median plane and parallel to the basic plane, as defined in ASTM F513-12 between the inside of the face protector and Points K and Sn on the facially featured head as defined in ASTM F513-2 form can be as much as 60 mm. The low-profile cage reduces that by up to 65% with the limiting factor being clearance for the nose. ASTM F513-2 is incorporated herein by reference in its entirety.

The basic plane and reference plane indicated in ASTM F513-2 are useful in describing certain aspects of examples disclosed herein. The basic plane is a plane that is located at the level of the external upper borders of the ear canal (external auditory meatus) and the inferior margins of the orbits of the eyes. The frontal plane is a vertical plane that is perpendicular to the median and reference planes and passes through the top of the head form. The horizontal plane is the plane that passes across the head at right angles to both the frontal and median plane. The median plane is a vertical plane that passes through the head form from front to back and divides the head form into right and left halves, and the reference plane is a construction plane parallel to the basic plane of the head form at a distance from it which is a function of the size of the head form.

The above example also improves field of view by reducing the number of vertical wires in the field of view by two (assuming 180° field of view) and improving visibility by making the wires out of focus.

Multi-Density Layers

High Density Components may be embedded into a low-density helmet. Optionally, in any example of helmet, multi-density layers may be used alone or in any combination of other features disclosed herein. Besides constraints imposed by traditional manufacturing methods, the separation of distinct hardware pieces allowed for the optimization of the mechanical properties of each part: metal screws for shear and tensile strength, plastic clips for unusual shapes and/or flexibility, metal nuts to minimize the risk of stripping threads for example. Therefore, helmets employ high density components embedded into lower density helmet material. By definition integrated hardware requires a single part to meet all the engineering requirements.

Examples of headgear include at least two mechanisms for meeting these requirements. The first is to continue to use multiple materials in additive manufacturing. One example in the context of fused deposition modeling is to have one hot end print the energy management layer material and a second hot end to print the integrated hardware in a second material. This approach has the advantage of requiring minimal design changes from a traditional manufacturer while still minimizing assembly.

A second approach, requires using a single material but varying the densities or the effective infill percentages to meet the desired mechanical properties. One example includes an energy management layer with a separate clip such as an integrated J-clip attached to the helmet. The energy management layer may have a low infill percentage such as <30% which results in a lightweight layer with desirable energy attenuation properties, while the integrated J-clip has a 100% infill percentage and therefore is completely solid, or the J-clip may just be a higher infill percentage than the energy management layer and thus not necessarily solid. The J-Clip is not only "attached" superficially but has a high-density foot that is between 2 and 10 millimeters into the energy management layer and spreads across the surface to spread any loads and minimizes the shearing of the component. The depth is determined by the application of the particular component, specifically components that put more force on the helmet or where stiffness is desired will typically require a larger foot. Additional details are disclosed below.

The advantages of these techniques include eliminating assembly as no screws or bolts are needed and do not need to be attached to the helmet, as well as providing lighter weight. The lack of traditional metal hardware having material optimized designs significantly reduce mass. Direct attachment to the energy absorbing energy management layer, rather than a hard shell, allows the further attenuation of impact forces to the wearer, particularly from impacts to the integrated hardware or any component in contact to the integrated hardware.

Additionally, using varying density layers may also help with reduced material utilized in the helmet and therefore reducing helmet weight and cost.

Any of these multi-density features may be used in any helmet alone or optionally in combination with any of the other features disclosed herein.

In other examples of variable density layers in a helmet, the density of the energy management layer may vary in any number of directions and patterns, e.g. front to back, side to side, and normal to the head going vertically away from the helmet. For example, one density of honeycomb like pattern may be close to the head, and another density in the same or different pattern may be disposed away from the head. In another example, a layer of material may be disposed in between two different density infills. This layer can be the same or a different material, a stiffer one to disperse impact energies or a lighter one to simply act as internal scaffolding during the printing process. Another example comprises infill patterns of the same density. Still another example comprises different infill patterns and different densities throughout the energy management layer. Any of these examples may be used alone or in any combination with other features disclosed herein in any helmet.

Using multi-density patterns improve 3D printing surfaces by providing adequate print support where needed and also helps to avoid having holes on top surfaces. Also multi-density patterns increase shell stiffness by up to 2×-20× by placing high density infill against the outer shell, and can decrease peak accelerations by up to 100% for high velocity impacts using ASTM F1045-15 impact standards with 4.5 m/s or greater velocities, or decreases peak accelerations by up to 50% for low velocity impacts using ASTM F1045-15 impact standards with 4.0 m/s or lower velocities. Multi-density patterns also provide a softer surface closer to the head with a density up to 100% less.

In any helmet example, a single pattern, single density 20% cubic infill using Cura 3.5 software may reduce helmet weight by up to 50%, can reduce the thickness of the outer shell by up to half, may increase shell stiffness by up to 5× by placing high density infill against the outer shell, as well as decreasing peak accelerations by up to 50% for high velocity impacts using ASTM F1045-15 impact standards under 4.5 m/s or greater velocities, or decreasing peak accelerations by up to 100% for low velocity impacts using ASTM F1045-15 impact standards under 4.0 m/s or lower velocities, and may provide a softer surface closer to the head with a density up to 400% less.

Sweat Gutters

Athletes sweat during play, which is further exacerbated by the insulating properties of a helmet. It is becoming more common to have various silicone wipers affixed to the inside of the helmet to redirect sweat like a rain gutter or to wear special headbands to absorb or redirect sweat from the eyes. Optionally in any example of a helmet disclosed herein integral wipers in the helmet design may be used, thereby eliminating assembly challenges and ensuring the correct positioning of these wipers to redirect sweat to the side of the head. The optional sweat gutters may be personalized to fit a helmet where the helmet is known to be a set distance from the forehead enabling the precise positioning of the gutters against the forehead. Too loose and sweat will bypass the gutters and too tight will cause discomfort to the wearer.

One or more sweat gutter elements may also be integrally formed with any of the examples of the headgear disclosed herein, using the same techniques as the fasteners described herein. These sweat gutters are often protuberances that extend outwardly from an inner surface of the helmet toward the head engaging the forehead comfortably. Or channels may be formed on the inner surface of the helmet. Thus, as beads of sweat run down the forehead, the gutters or channels divert the sweat beads laterally away from the eyes. Moreover, the position and design of the sweat gutters may be personalized to match the helmet wearer's anatomy thereby ensuring that the sweat beads are directed away from the eyes and do not flow under the sweat gutters while providing comfort to the wearer.

Figure 36:
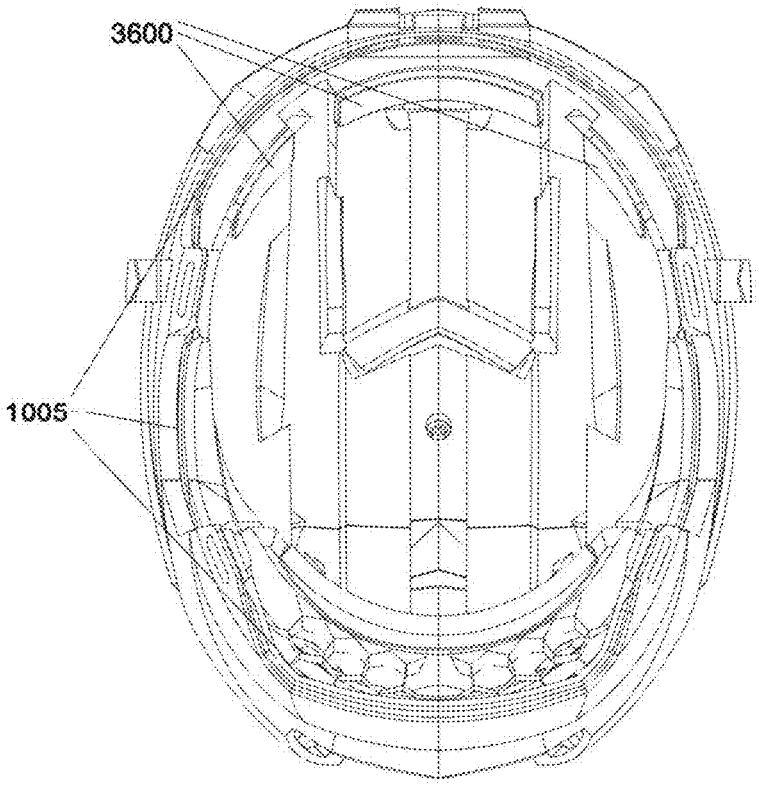
FIG. 36 shows an example of sweat gutters.

FIG. 36 illustrates an example of sweat gutters. In any example, the sweat gutter may utilize a 2-4 mm thick closed-cell ethylene-vinyl acetate comfort foam with a pressure-sensitive adhesive backing affixed to the inside front brow of the helmet, above the eyes. Any material could be substituted, including non-foam materials such as fabric, injection-molded foams, silicon, polymers with durometers below 98A and materials designed to reduce skin friction such as fluoropolymers, and combinations of these. Any helmet may have one or more channels 3600 positioned above the eyes that are at 0.2 to 25.0 degree angle from the horizontal and 1-5 mm thick sweeping away towards the ears. Higher angles are more effective at channeling sweat away under a variety of circumstances but require more vertical space in the helmet. Any example may have a break in the pads to accommodate venting and cooling the face. Gutters 1005 may be present and allow for painting. Additional disclosure on gutters 1005 are elsewhere in this specification. Sweat gutters in this or any example may be integrally formed with the helmet or they may be independently attached to the helmet.

Figure 37:
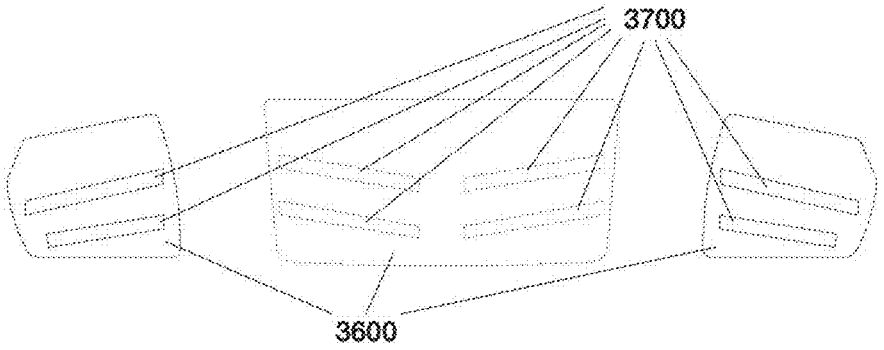
FIG. 37 shows another example of sweat gutters isolated from the helmet.

FIG. 37 shows an example of gutters 3700 placed in the forehead or brow portion of a helmet to divert beads of sweat away from the eyes.

Figure 38:
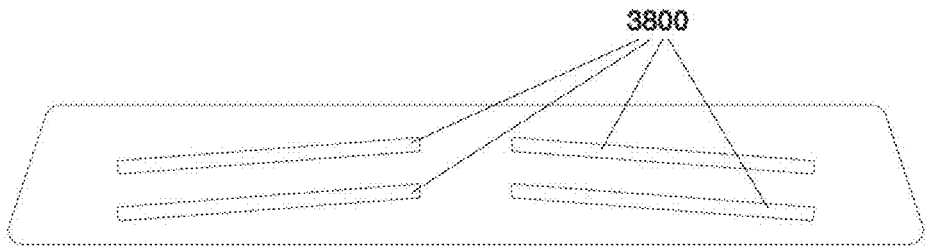
FIG. 38 shows yet another example of sweat gutters.

FIG. 38 shows another example of sweat gutters. Continuous channels 3800 across the top of the brow. However, any number of channels, orientated at an angle from the horizontal will be effective. Furthermore, while channels are cut through the 2-4 thick foam in this example, embossing channels 0.5-2 mm mm above the surface, debossing, laser etching 0.5 mm—to the depth of the material are also alternative examples of sweat gutters.

Integral Fasteners

Helmets used in contact sports requiring a face cage (hockey, lacrosse, football, etc.) utilize various hardware, most commonly nuts and bolts, to fasten the cage to the helmet and possibly to attach other accessories (e.g. visors, cameras, straps) to the helmet. This hardware adds assembly time, manufacturing cost/complexity, a point of failure from rust and impacts and is visually disruptive to the design. Any helmet example herein may have hardware which is integral with the helmet as described herein, and not require separate, discrete hardware components such as bolts, screws, nuts, etc. Integral fasteners help prevent direct contact with the head during an impact and also increases the effective offset available to absorb energy.

Any helmet may use additive manufacturing (e.g. 3D printing) or other processes known in the art to integrate hardware into the helmet, and may also include other individual solutions such as those described herein.

The disclosure below describes various examples of integrated hardware such as front cage mounts and what would traditionally be J-clip mounts on the side of a hockey helmet.

Headgear such as helmets often include a face cage to protect the face while still allowing unobstructed viewing. These cages are often attached to the helmet using separate metal or plastic fasteners which can easily rust and fail or be damaged due to point impacts. Other fasteners may be used to attach other items to the headgear such as straps, cameras, lights, etc. These fasteners can similarly also fail. Using modern additive manufacturing processes or other manufacturing techniques known in the art allows these fasteners to be integrally or monolithically formed with the helmet itself and thus no separate assembly of the fastener with the helmet is required. For example, the front cage mounts and J-clips on a hockey helmet may be made with additive manufacturing processes such as 3d printing so they are integral with the helmet itself. And this also allows the hardware to be designed to have optimal mechanical and energy absorbing properties that are desirable during use. Also, the hardware may be designed to make manipulation and use of the hardware easier, such as by allowing one handed use or facilitating use by a gloved hand. The fasteners or any hardware may be formed from the same material as the helmet or a different material may be used. Integral fasteners may be optionally included in any helmet design.

Energy Absorbing Cage Mounts

Hockey helmets (and other helmets) typically use a combination of two or more cage clips that fix the cage to the helmet allowing it to pivot and two J-clips that act to hold the cage in place. In hockey, sweat tends to rust the bolts used to fasten the clips complicating the removal of the cage or in extreme circumstances leading to premature failure.

The clips may be high density components mounted to a lower density component of the helmet. Traditional bolt holes may still be present to facilitate the use of fasteners to allow the removal of the face cage by the wearer. Like the examples herein, the high density mounting surface provides strength while the low-density backing provide energy absorption minimizing the risk of head trauma.

Quick Clips

Hockey helmets often have two cage straps, one on each side, to anchor the cage and prevent the cage from swinging out, away from the player, pivoting on the cage mounts. The straps are traditionally affixed to a button on the backside of the helmet. As players wear thick gloves and the buttons are in a blind spot, securing the straps is challenging and in some cases, may lead to a partially secured cage. Like other hardware, the metal buttons rust and deteriorate over time.

Quick clips may be integrally formed in any example of helmet herein, with the outer shell layer formed by additive manufacturing processes such as 3D printing.

Quick clips may be used with any example of helmet herein, and may be used to help engage and disengage the cage. Detailed below is an additional example comprising a clip made of TPU or another polymer with a Shore durometer between 80A-80D. The polymer should be durable enough to withstand impacts, stiff enough to function as a cage fastener and flexible enough to provide a pivot (if a traditional pin and socket aren't utilized). The fastener is hollowed out at various points to provide the ideal combination of weight, strength and flexibility for the intended use case, specifically the lever arm performs best with a high stiffness, the pivot with a high degree of flexibility and the base with an intermediate stiffness to dampen impact forces while disallowing excessive movements of the cage such as impacting the face or disengaging from the quick clip. The quick clip may include several components including a pivot which can be a traditional pin/shaft which turns in a socket or can be a virtual one where the fastener thins out to allow flexing without any permanent deformation of the fastener; the lever may be made of the same material or a more rigid material to minimize the profile, or portion of the quick clip that extends beyond the helmet. The geometry of the lever is angled to allow the full depression of the lever to the helmet allowing the release of the cage, either by gravity pulling the cage away or a gentle pull from the user. Also, the hook that cradles the bottom portion of the cage, must extend to at least the midpoint of the wire of the cage to avoid accidental release, and the fastener also has angled surfaces that guide the wire cage into the hook to accommodate manufacturing tolerances in the cage.

The clip may expand out when the cage is pressed into it and then compress to hold the cage in place, typically requiring less than 100N of force to attach (i.e. push in) per clip. Alternatively, the levers can be utilized to open the clip and allow the cage to attach effortlessly.

The quick clip may be used on only one side of the helmet to allow a single-handed release. With the other side utilizing an optional integrated J-clip that retains a relatively lose hold on the cage but braces the cage from pivoting up towards the player's face. Finally, it's also possible to create the clips in whole or part out of metal, or a polymer using techniques known in the art. The previous descriptions are disclosed in greater detail in the description and figures that follow.

Figure 3A:
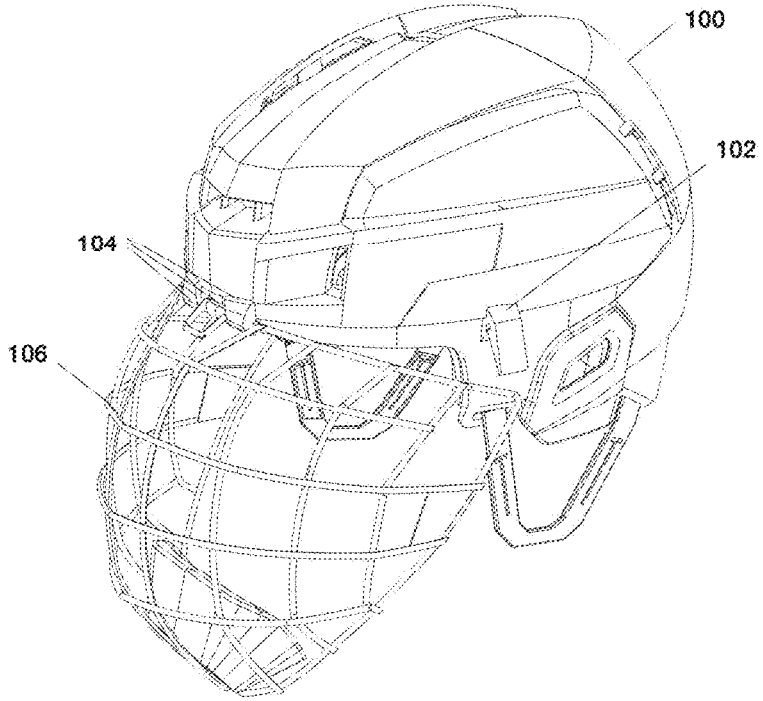
FIG. 3A shows a perspective view of a cage coupled to a helmet.
Figure 3B:
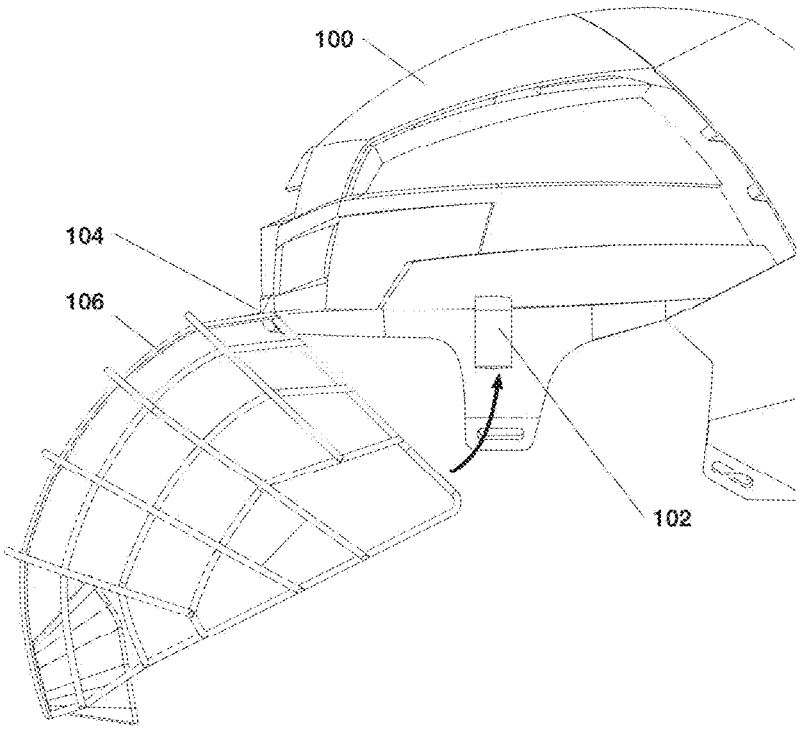
FIG. 3B shows a side view of FIG. 3A.

FIG. 3A and FIG. 3B illustrates how the cage 106 is attached to the helmet 100 via the quick clips 102 and the center clip 104. FIG. 3B further shows how the cage pivots on the center clip from a position away from the face to one which locks the cage via the quick clips.

Figure 4:
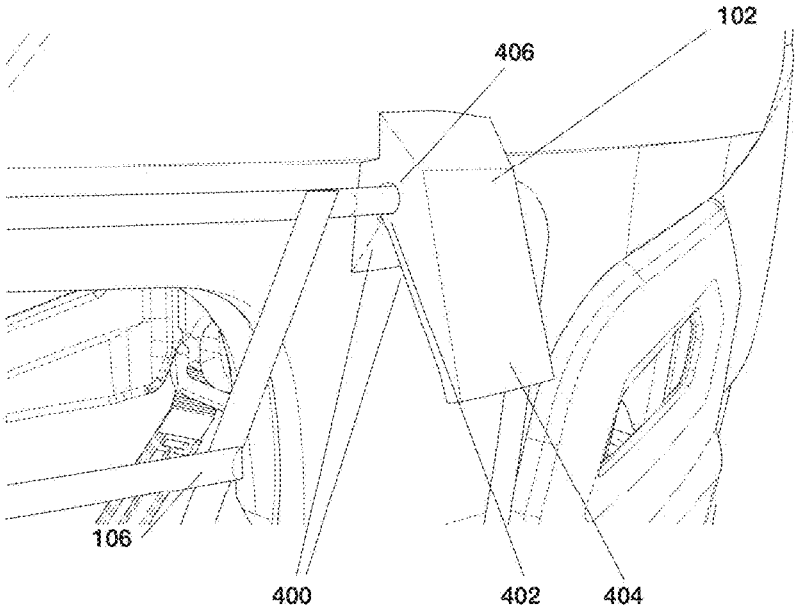
FIG. 4 shows a perspective view of a quick clip on the helmet with the cage engaged.

FIG. 4 is a close-up showing the cage locked into the quick clips. The major components of the clip are ramps 400 that guide the cage into a physical latching feature 402. A pull lever 404 allows the user to pull the clip away from the head, pivoting at 406 and freeing the cage either from gravity or the user pushing downward on the cage.

Figure 5A:
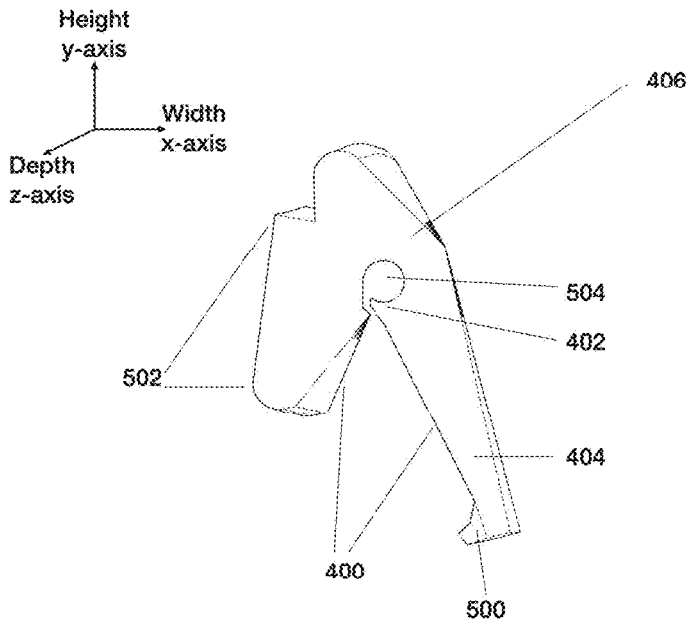
FIG. 5A shows a front view of the quick clip in FIG. 4 isolated from the helmet.
Figure 5B:
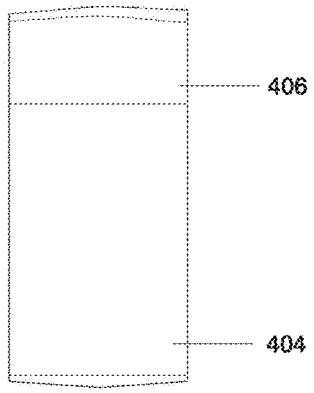
FIG. 5B shows a side view of the quick clip in FIG. 5A.

FIG. 5A and FIG. 5B illustrate a perspective view and end view, respectively, of one example of the quick clip which may be used with any helmet. The overall width of the clip may be 5 mm to 25 mm with 15 to 20 mm providing a balance between weight, retention strength and ergonomics (the quick clip should be operable by a hand, sometimes with a glove on). In any example, the entire mechanism may be made of thermoplastic polyurethane with a Shore Durometer of 85A or more and a yield elongation of at least 10% to allow bending at the pivot without any permanent deformation of the quick clip. However, the part can consist of any material and dimensions that provides a combination of durability, flexibility at the pivot and energy absorbing properties on impacts.

A ridge or texture 500 underneath the quick clip allows better engagement with a bare hand or one wearing a glove to ease pulling the lever.

The base of the quick clip 502 is comprised of a wedge that allows it to be wedged into a female counterpart on the helmet and bonded with an adhesive or solvent appropriate for the polymers in use. Alternative methods of attachment include the use of a bolt and nut or fabricating the part directly on the shell or outermost service of the helmet. Or the quick clip may be integrally formed with the helmet during additive manufacturing processing such as via 3D printing.

A retention tunnel 504 is where the wire cage rests when the quick clip is fully engaged. The diameter of the tunnel may be 0.01 mm to 3 mm greater than the wire it encapsulates, or any size as needed. Any less and the difficulty of engagement increases, any more the cage may rattle while retained and the probability of accidental disengagement increases. The underside of the tunnel 402 mimics the shape of the underlying portion of the cage to maximize engagement. Its geometry is specified to lock the cage further by pulling the quick clip closed when the cage is pulled downward without releasing the lever. The topside of the tunnel may be flat to facilitate varying tolerances in cage dimensions, specifically the width.

The guide ramps 400, typically between 20 to 70 degrees from the vertical or entry point of the cage. The ramps guide the cage wire into the latching mechanism and simplify attachment.

A lever at least 15 mm from the center of the wire to the edge of the lever can be pulled to release the cage. Specifically, pulling the lever away from the helmet opens up the hook so the cage can drop out, or be pulled out of the retention tunnel. Examples may optionally include texture and ridges on the underside to facilitate grip when pulling on the latch.

The pivot 406 above the hook works with the lever to allow the clip to open. This example has an implicit pivot by using a flexible material for the quick clip and by thinning the region above the retention tunnel relative to the rest of the clip. However, the pivot can utilize a physical pivot consisting of a metal or plastic pin or spring if desired.

The manner of using the quick clips may include swinging the cage along the center clips as previously discussed in FIG. 3A and FIG. 3B. When the cage approaches the helmet the wires of the cage are forced along the guide ramps into the retention tunnel. While placing one hand on the top of the helmet, the player can push the cage towards their face with the other hand until a subtle click is felt indicating the helmet is now latched into the quick clips (optionally one on each side of the helmet).

To disengage the helmet, the player puts a hand on each side of the helmet. The thumb is used to pull the lever on each side of the helmet away from their head while using their index fingers to push the cage down. The cage will drop and pivot off the front clips with ease.

Figure 6:
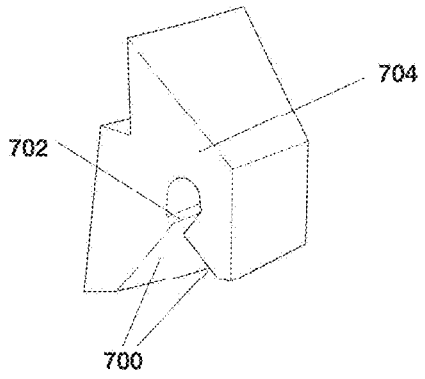
FIG. 6 shows a perspective view of another clip.

FIG. 6 illustrates a dummy clip that can be utilized on the left or right side of any helmet in lieu of one of the quick clips. Doing so enables one hand operation of the cage. Like the quick clip, ramps 700 guide the cage into the dummy clip. A small notch 702 helps retain the cage and the area on the top of the clip 704 can flex to facilitate the release of the cage. The size of the notch and the corresponding gap in the dummy clip determine the ease of the release and retention of the cage.

Figure 7:
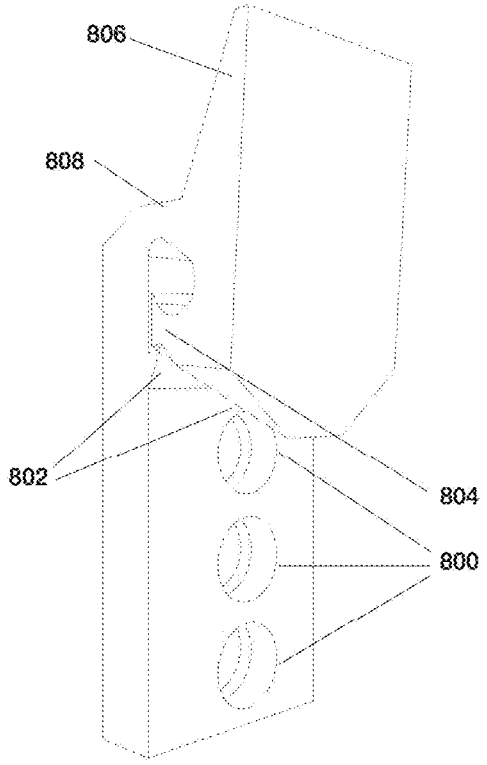
FIG. 7 shows a perspective view of still another quick clip.

FIG. 7 illustrates another example that may be used with any helmet, where the clip is bolted onto the helmet via two or more holes 800 with bolts, screws or other fasteners. Guide ramps 802 and a retention hook 804 operate as in previous examples. This clip may use at least two bolts to secure the clip to the helmet. Additional holes facilitate the ability to adjust the vertical position of the clip by unscrewing and screwing the clip into position.

Figure 8:
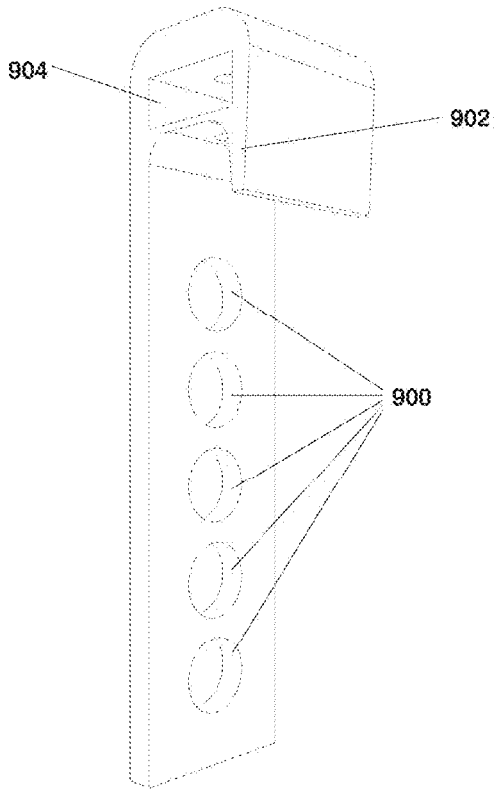
FIG. 8 shows a perspective view of another quick clip.

FIG. 8 illustrates another example that may be used with any helmet, that utilizes multiple bolt holes 900 and a J-clip mechanism 902 where the clip utilizes magnets located in a pocket 904 to attract and hold a magnetic cage (e.g. low carbon steel) in place. The use of neodymium or other powerful magnets provide strong magnetic forces though the clip but can use any magnetic material. A non-magnetic cage (e.g. titanium, magnesium) can be used when coupled with magnets along the top edge to mate with the clip.

Figure 9A:
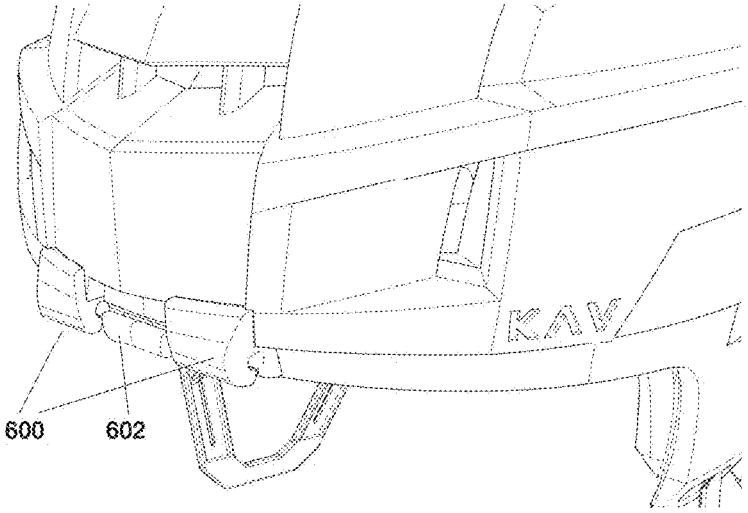
FIG. 9A shows a perspective view of a front clip on a helmet.
Figure 9B:
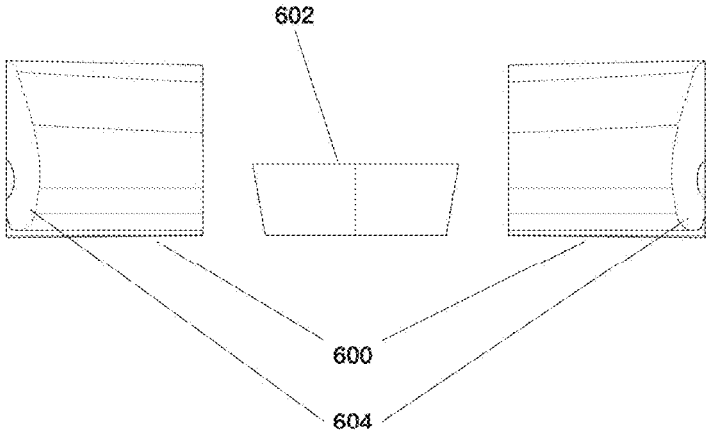
FIG. 9B shows a front view the front clip of FIG. 9A isolated from the helmet.
Figure 9C:
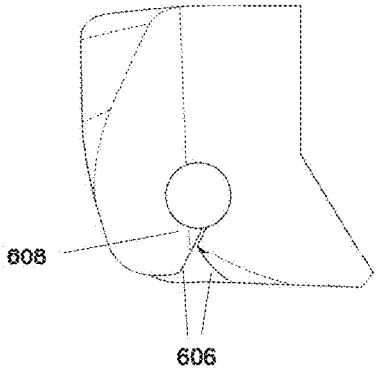
FIG. 9C shows a side view of the front clip in FIG. 9A.

FIG. 9A, FIG. 9B and FIG. 9C illustrate front clips integrated into the outer shell layer and that are used to help mount the cage to the shell. Specifically, two downward facing clips 600 are coupled with a 602. The latter is optional but enhances retention required to secure the cage for higher velocity impacts (e.g. 100+ mph hockey puck impacts). Any of these examples may be used with any of the helmets disclosed herein. Chamfers on each side of the clips 604 increase clearance when the cage is raised. Mini ramps or radiuses 606 facilitate mounting the cage into the clips. A hook 608 facilitates cage retention on impacts.

In any example, the clips are made of thermoplastic polyurethane with a Shore Durometer of 85A or more. However, the part can consist of any material that provides a combination of durability, flexibility to snap the cage into and energy absorbing properties on impacts. The front clips are directly printed onto the shell and/or energy management layer of the helmet. The clips themselves are solid or more than 50% infill to maximize the strength while minimizing how much they protrude from the helmet. The backing of the clips may also be solid with decreasing density as it approaches the head. This variable density maximizes strength and stiffness near the cage while minimizing weight and providing some energy attenuation closer to the wearer's head.

The clips may be spaced at least 4-8 cm apart measured outside to outside. Any less and the cage may easily twist out on impact and will wobble on opening and closing the cage. Any wider and the cage requires a long straight bar across the top leading to an awkward cage with gaps along the front brow of the helmet.

The opening of the clips may face down such that the force from frontal impacts are perpendicular to the opening of the clips. The ends of the clip touch to maximize the grip and surface area engaging the cage.

Chin Cup

Chin cups are intended to help position and anchor the helmet into a desired position on the head and in the case of hockey, to provide some attenuation of forces to the chin from impacts to the mask. To date, most chin cups are a flexible rubber like plastic or a thick foam. The former only helps position the chin guard, while the latter is typically at least 15 mm thick at their thinnest point at the point of the chin. Examples of improved chin cups are disclosed herein, may be used in any helmet, and provide at least some of the following advantages: more effectively distributes forces across the entire chin; facilitates a thinner chin cup for the same impact absorption, which in turns facilitates a lower profile cage; provides effective height adjustment for additional comfort and improved safety via better fit; stiff chin cup mounting plate to distribute forces; and vents for fluid (sweat, water, sports drink) drainage.

Any example of a chip cup may include a clip that has enough friction to stay in place on the cage and slide up and down the wires in the cage. A softer material or one with less infill or less density functions to cradle the chin. A stiffer material, or one with more infill or higher density to provide an effective barrier is utilized to prevent the cage wires from digging into the chin cup. Guides inside the chin cup channel moisture and sweat into vents that drain the fluids away from the player. The guides secondarily provide ventilation.

A variable density or multi-material chin guard may have a stiffer material placed against the metal cage and a softer material or lower density version of the same material for comfort, conformance to the chin and absorbing energy from lower velocity impacts. A chin cup wherein the cage attachment mechanism comprises one or more flexible or stiff clips that slide along the rails of the cage providing adjustability in fit. A chin cup with vents and drainage along the bottom of the chin cup to allow the drainage of various liquids and prevent the accumulation of fluids or moisture in the pocket of the chin cup. A chin cup that's up to 30% thinner measured from the chin to the backside of the chin cup.

Occipital Cushion and Retention Mechanism

An occipital cushion may be used in any example of helmet and provides a comfortable and configurable padding mechanism for a particularly sensitive area of the head. The cushions can be replaced with different sizes and densities to provide a custom fit. The cushions are attached to a trampoline mechanism that provides a spring like mechanism and additional support/flexibility.

Figure 10A:
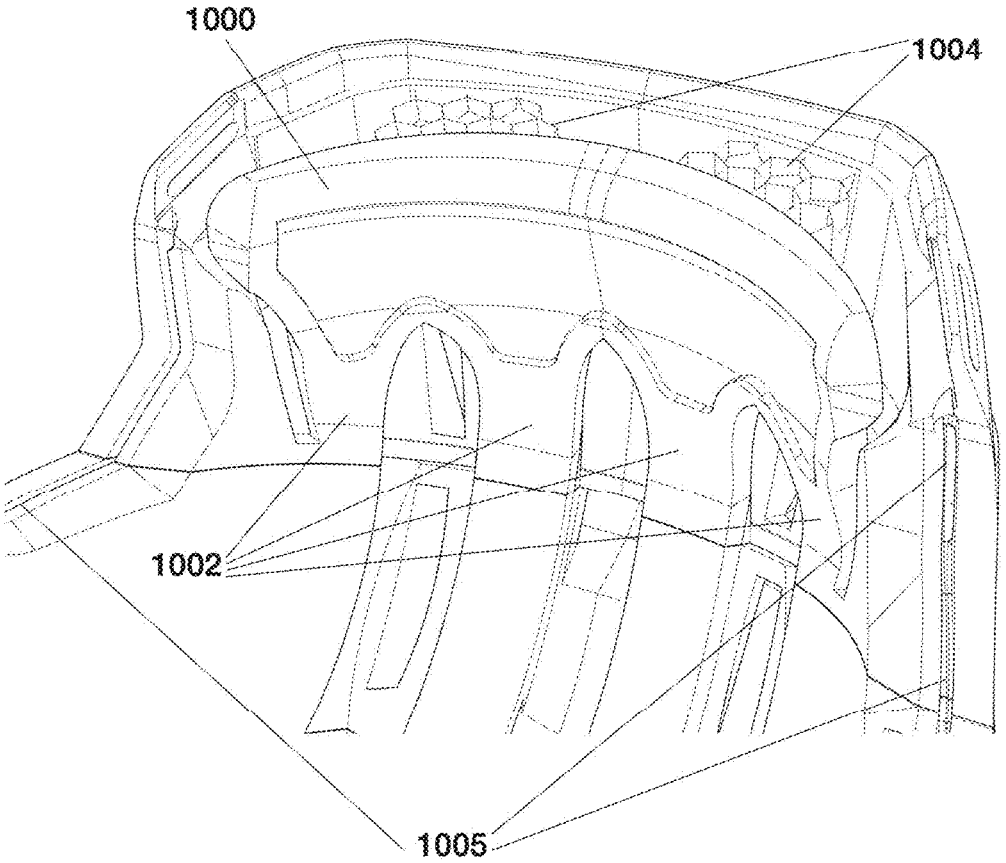
FIG. 10A shows a perspective view of an integrated neckroll and a masking groove.
Figure 10B:
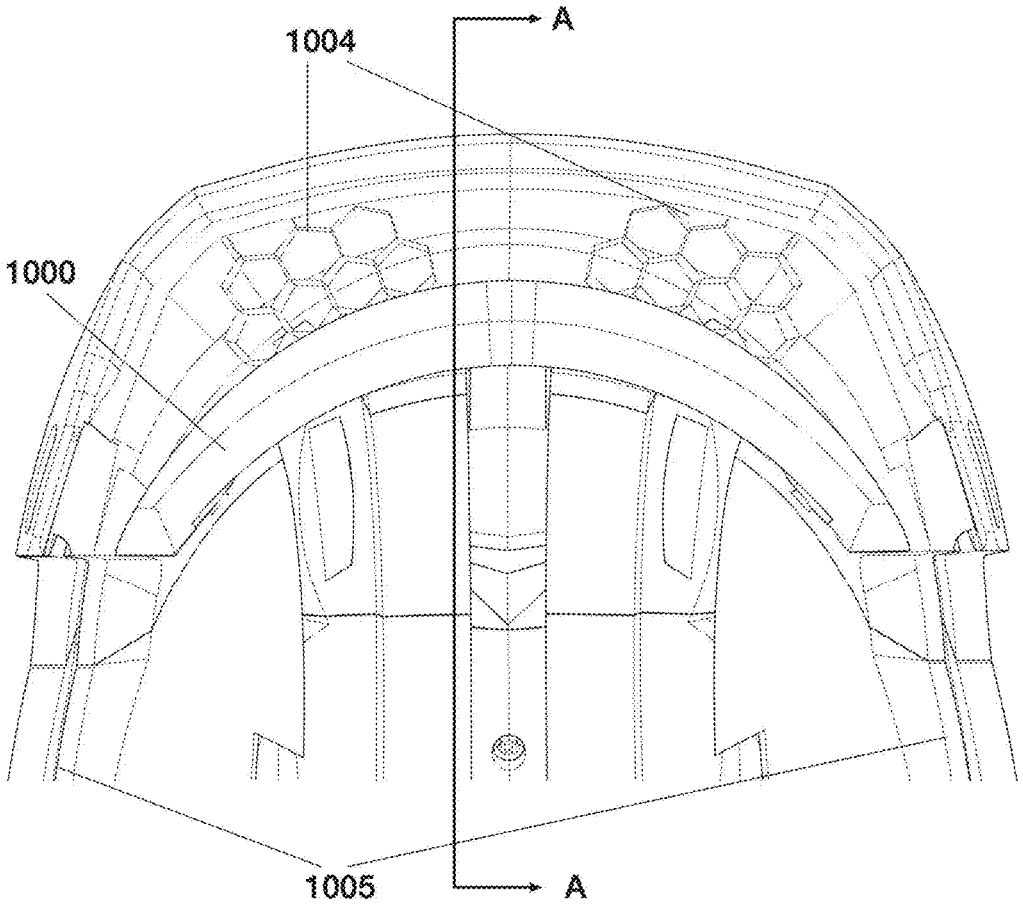
FIG. 10B shows a bottom view of FIG. 10A.
Figure 11:
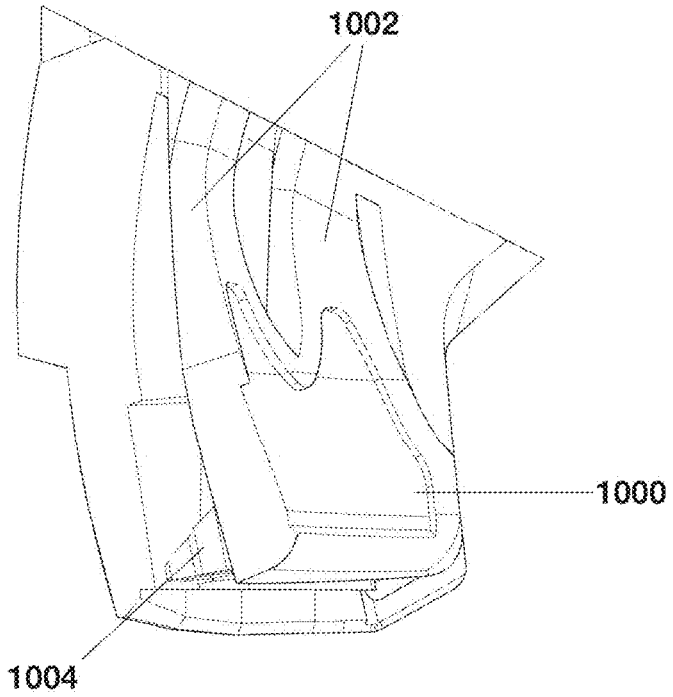
FIG. 11 shows a partial cross-section of FIG. 10A

FIG. 10A, FIG. 10B and FIG. 11 show an occipital cushion and helmet retention mechanism that may be used in any of the examples of helmets disclosed herein. The occipital cushion may be coupled to the helmet with a trampoline mechanism composed of an occipital pad 1000, one or more armatures 1002, that facilitate movement away from the head and an optional spring mechanism 1004. Grooves 1005 are discussed below.

In any example, the entire mechanism is fabricated via additive manufacturing, as a single part integrally along with the helmet and made of a single polymer, like Thermo Polyurethane with a Shore Durometer between 85A-100A or more and an elongation of yield of at least 10% to allow bending at the arms 1002 without any permanent deformation of the occipital trampoline. However, the part can consist of any material and dimensions that provides a combination of durability, flexibility at the pivot and energy absorbing properties on impacts.

The overall spring force provided by the arms 1002 and springs 1004 is between 5 and 50N upon depressing the occipital pad 10 mm.

Assembly

The helmet may be fabricated as a single monolithic or integral helmet or it may be fabricated in various sections which are then coupled together. For example, pins may be used to help align and join sections together, and/or dovetail joints may also be fabricated into the helmet sections to help join them together. Various adhesives and solvents may also be used to help join sections of the helmet together.

Assembling Large Parts from Subcomponents

Attachment interfaces common in injection molding, typically don't translate well with additive manufacturing, specifically fused deposition modeling, due to geometries that are may be too thin, require supports or don't operate well in the allowed tolerances. Some of the following techniques may be used in any of the examples of helmets alone or in combination with one another to assemble a helmet.

In any example, pins may be used that help align parts but also pull the parts toward each other to minimize unsightly seams.

In any example, dovetails, similar to what's used in furniture but of a geometry that's printable without supports may be used, are self-aligning and have a lip that replaces the dovetails with a single straight line.

Ultraviolet light (UV) or heat cured epoxy may be used to adhere components together.

UV/ozone/plasma/heat surface activation may be used to facilitate adhesion of components together.

UV curing through TPU exploiting non-absorbed wavelength may be employed.

Relaxation via controlled temperatures that minimize the warping and thermal stresses built up during 3D printing layer upon layer. The relaxed parts provide a better fit and finish.

Helmets may be designed for printability such as orienting air channels in the vertical direction.

Various chemicals may be used to solvent bond (e.g. using DMF solvent) components together.

Pins that Align and Pull Parts Together

Figure 42:
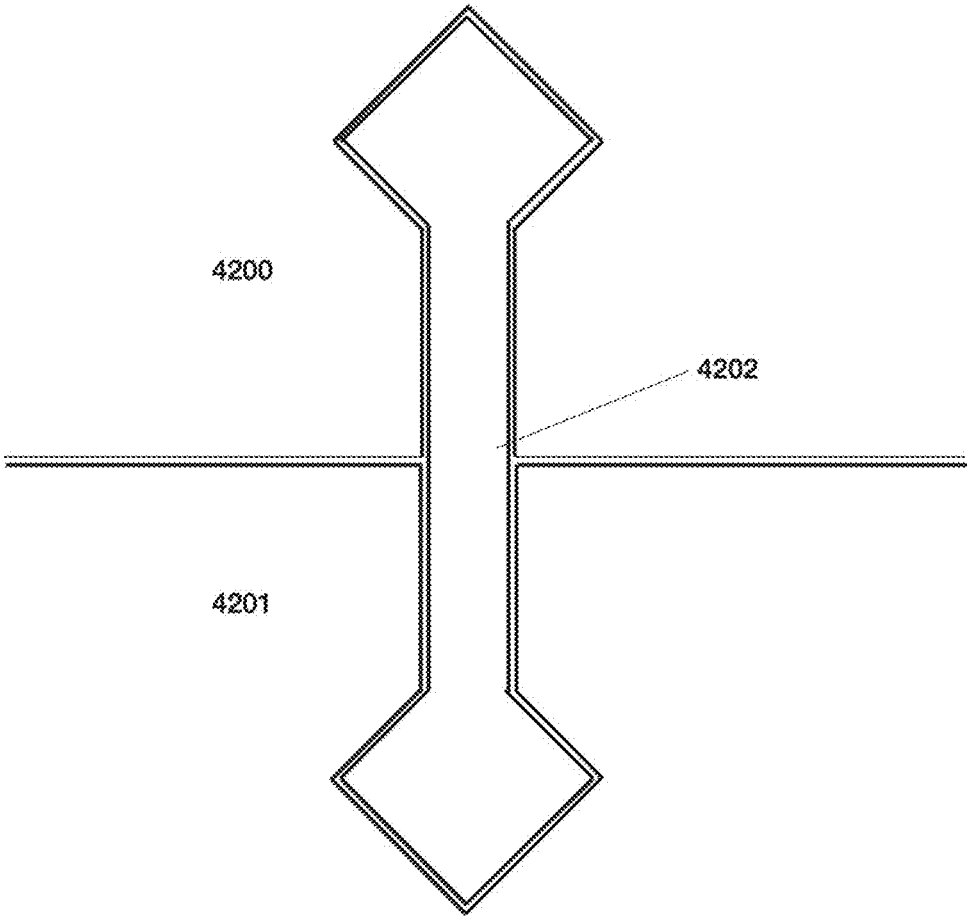
FIG. 42 shows a close-up example of a pin used to join sections of a helmet together.

Pin holes may be placed by software optimized to minimize the number of pins to reduce assembly, but with sufficient coverage to insure alignment of the seams. FIG. 42 is one example of the pins placed into the helmet. The geometry is designed to encourage a press fit that subsequently applies pressures against two parts. This invention is optimized for additive manufacturing, requiring no support and addresses the warpage of parts by applying pressure to flatten adjacent surfaces facilitating the use of adhesives for a more permanent bond.

FIG. 42 shows part A 4200 and part B 4201 of a helmet joined by a peg 4202 with enlarged opposite ends that help draw part A and B together.

Another example of a pin provides a suction cup like attachment to serve the safe function as the pin via a mechanical mechanism.

Biscuits

Traditional pins and clips for part alignment and/or joining of plastic parts may be ill suited for flexible materials. Small pins may be too flexible to facilitate joining and larger pins/clips may be difficult to print without adding weight, complexity, compromising aspects of the design.

Biscuits may be used to help join sections of the helmet together in combination with other joining processes such as solvent bonding, adhesives, thermal energy to fuse materials together, etc. The use of biscuits and joining techniques may be used with any example herein.

After printing independent segments, biscuits (discs, toroids or loops, or other shapes known in the art) may be used for alignment prior to welding. Such biscuits may be flanged, textured or curved in the manner of a lock washer to provide greater friction. The negative space for the biscuit is printed in place, including features to key in place such as fitting to a hole.

Examples may include two biscuit receptacles of irregular shape for keying to another segment on the flat plane. The process allows the use of rigid biscuits to align elastomer parts using pre-made receptacles. Biscuits in the form of conventional flat washers align the components together.

Dovetail Specific Innovations

Software maybe used to generate dovetail surfaces with configurable setbacks and tolerances to make assembly possible and a uniform finished seam.

Figure 43A:
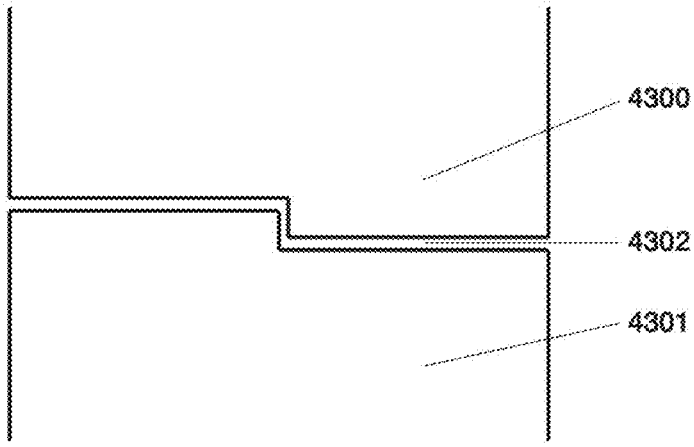
FIG. 43A shows an example of a joint used to coupled helmet sections together.
Figure 43B:
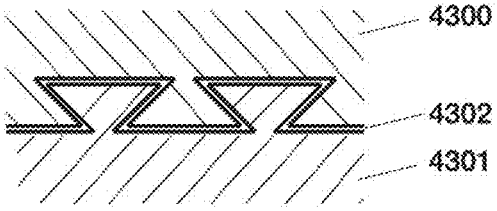
FIG. 43B shows a front view of the joint in FIG. 43A.

FIG. 43A shows a side view where Part A 4300 is joined with part B 4301. A gap 4302 is disposed between part A and B. Also, a lip is generated so the front view shown in FIG. 43B hides this. The jagged edge allows Part A and Part B to slide on top of each other for assembly.

Helmet Baking

Optionally, any helmet may be formed from materials which may be placed in an oven to heat up the helmet or be otherwise heated using other techniques. The helmet owner may then place the helmet on the head or in a jig and form at least a portion of the helmet to match the shape and contour of the wearer's head. The entire helmet may be shaped, or only portions maybe shaped. The entire helmet may be heated and all or select portions may be shaped, or only portions of the helmet may be heated and shaped. For example, a hot air gun may be used to heat localized regions of the helmet.

In any example, the helmet is comprised primarily of an energy management layer which sits on the head and comprises the bulk of the offset between the head and the outermost layer of the helmet. In any example the energy management layer is made of a thermoplastic polyurethane. However, the part can consist of any material that becomes moldable above 125 degrees F. or another desired temperature.

In any example, the helmet may be molded by placing in a convection oven between 150-175 degrees F. for five minutes. However, it is possible to bake as low as 125 degrees F. for a longer duration and as high as 225 degrees F. for a shorter duration. This softens the helmet materials enough to be shaped. To make the helmet wider or narrower, the helmet may be placed in a vise, special purpose jig or similar mechanism to squeeze the helmet and change the overall interior dimensions from an oval to rounded shape or vice versa.

In order to shape the helmet to the smaller variations of a user's head, it can be placed in an oven at 175 degrees F. for at least two minutes or 150 degrees F. for at least five minutes. The lower temperature may be more comfortable for children or people who find 175 degrees F. too hot. Placing the helmet on the wearer's head till the helmet reaches room temperature will mold the helmet to the wearer's head.

It may be useful to remove the ear loops, chin straps, chin strap clips, cage and chin cup as part of this procedure. Metal parts on these accessories may be uncomfortable to handle when heated. Other plastics may have unpredictable behaviors when heated and cooled. Removal is optional.

Construction

A helmet may be attractive, light, comfortable, protective and affordable to manufacture. These qualities may be traded off. For example, a very thick helmet can be more protective, but will be heavier.

Commercially available helmets typically have an injection molded outer plastic shell. A separate, discrete, or non-integral foam energy management layer is then attached to the outer shell. Having many fabrication steps results in a cumbersome and costly manufacturing process. Rigid materials, typically injection molded, vacuum formed or die-cut, require special mechanisms to allow a comfortable fit. This limits the available trade-offs for a created helmet.

Improved processes disclosed herein allow a single 3D printed fused filament additive process to simultaneously create a shell, an energy management (impact absorbing) layer, and an optional comfortable liner against the skin, or sections that can be easily joined together. Other additive manufacturing techniques, including but not limited to stereolithography, digital light processing, selective laser sintering, electronic beam melting, laminated object manufacturing and binder jetting, can also be used in conjunction to these processes. Manufacturing may also entail multiple individual parts created that are subsequently bonded or attached.

3D printing allows a more attractive appearance by not requiring shapes that allow mold release, vacuum forming or die cutting. Customized design elements such as player name or team logo may be incorporated on each helmet without additional tooling. Comfort is enhanced by manufacturing for the customer's requirements (for example, head shape) and by the choice of printed structures described herein, including heat and sweat management and air flow. The helmet can be more protective and lighter by continuous variation of density and structural orientation of inner material. The manufacturing process has fewer steps and tooling for reduced costs.

Alternative Energy Management Layer Infill Geometries

FIG. 12 through FIG. 35 show an example of helmet construction that may be used in any example of helmet disclosed herein. There are optionally up to seven layers, designated parts A through G. Parts B through F are created simultaneously during 3D printing of thermoplastic polyurethane, and Parts A and G are applied after printing. Any one or more of the seven parts may be included in a helmet. Additional disclosure related to Parts A and/or Part B may be found in the Surface Treatments section below and the Polymer Shell section below. Additional disclosure related to Part D may be found below in the Energy Management Layer Optimization section below.

Figure 12:
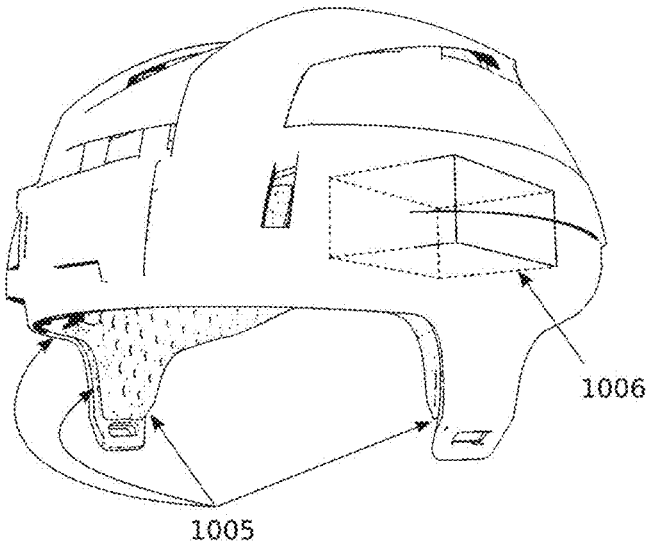
FIG. 12 shows a front perspective view of a helmet highlighting a section of helmet which is illustrated in FIGS. 13-35.
Figure 13:
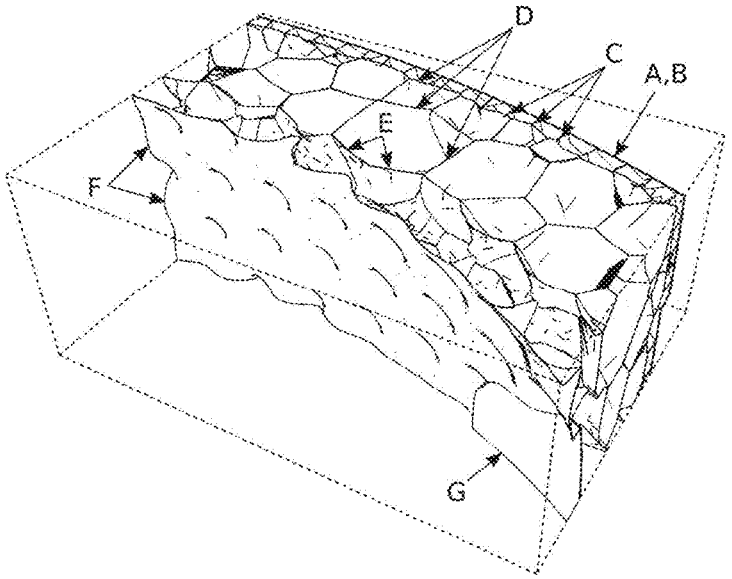
FIGS. 13-35 show various layers of the section of helmet in FIG. 12.
Figure 19:
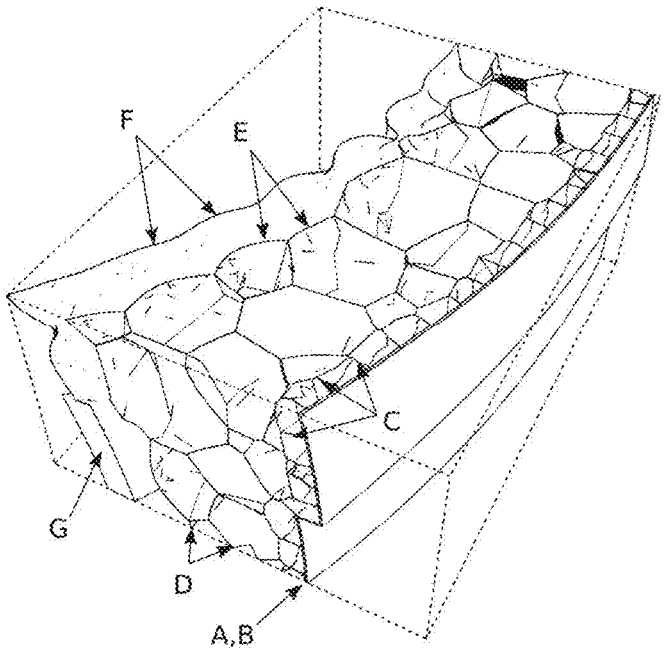
Figure 20:
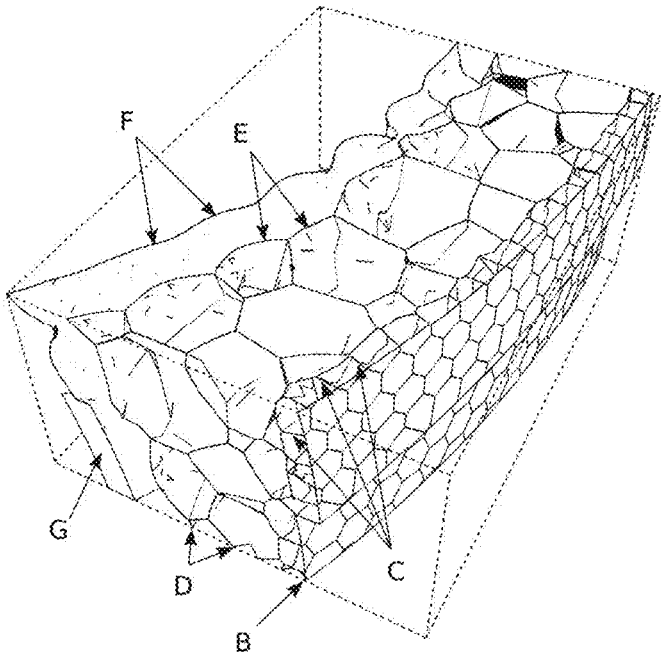
Figure 21:
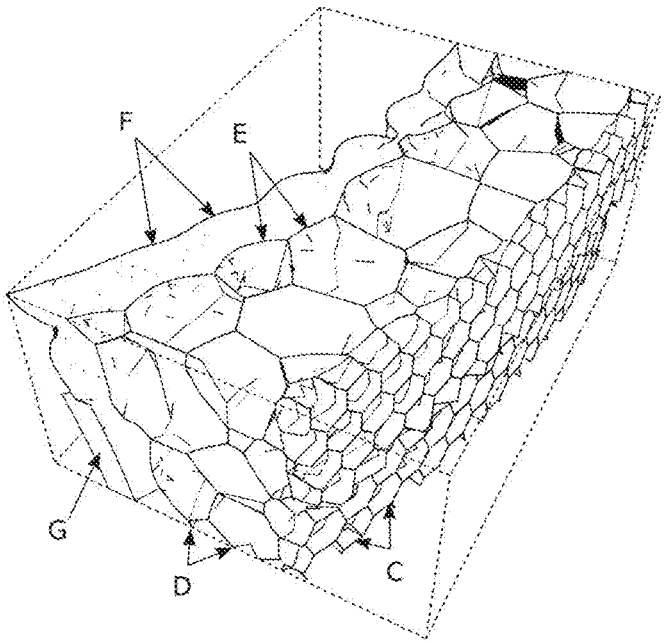
Figure 22:
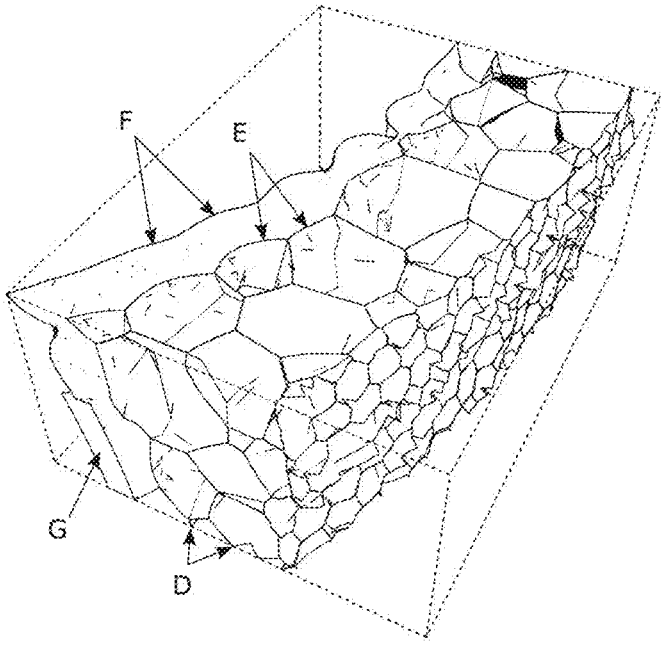
Figure 23:
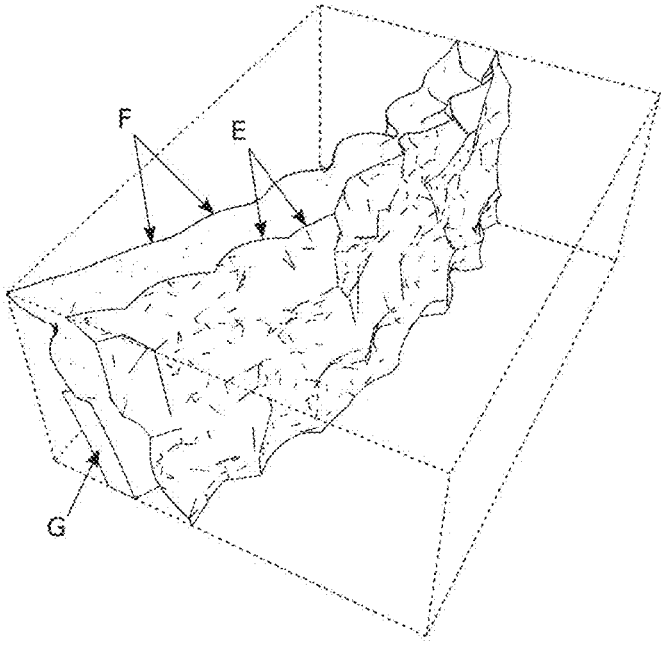
Figure 24:
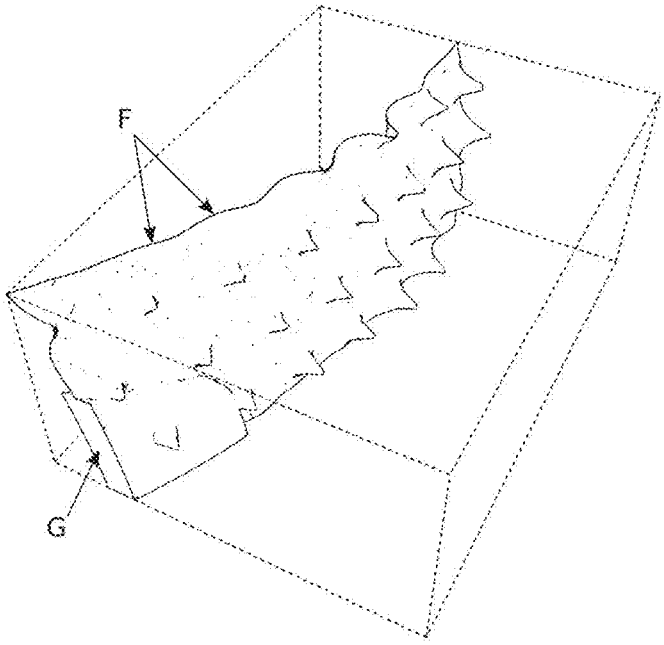
Figure 25:
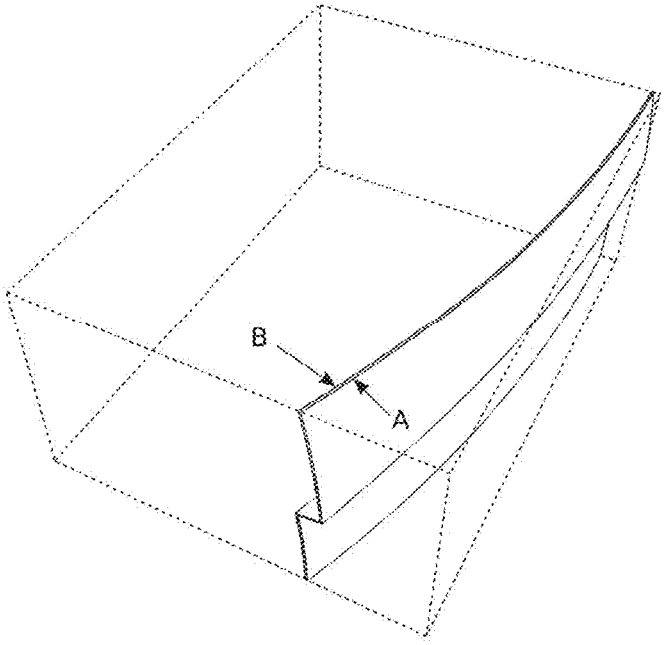
Figure 26:
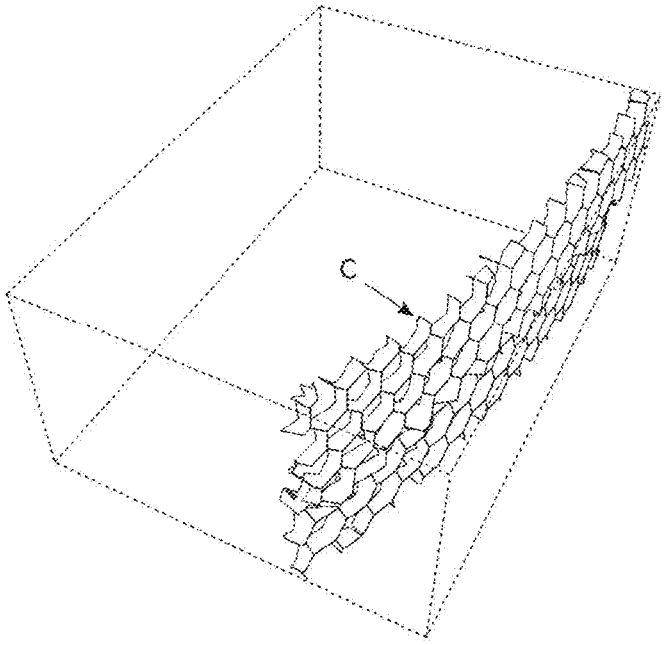
Figure 27:
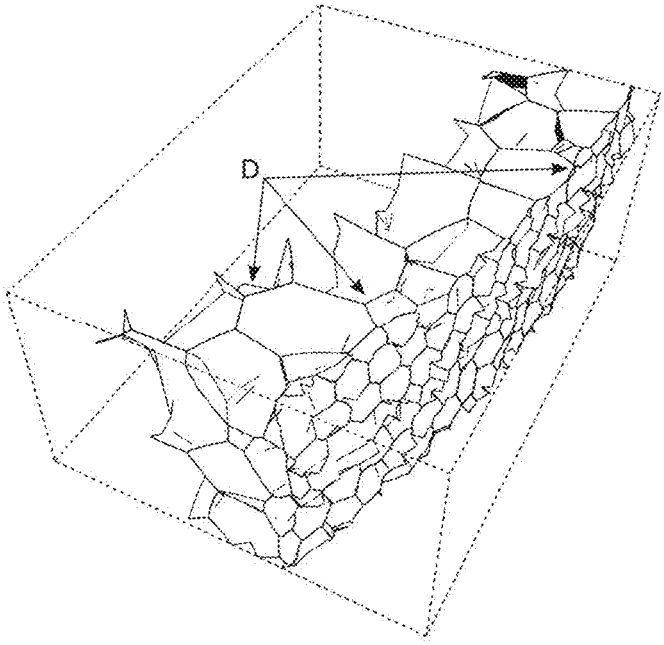
Figure 28:
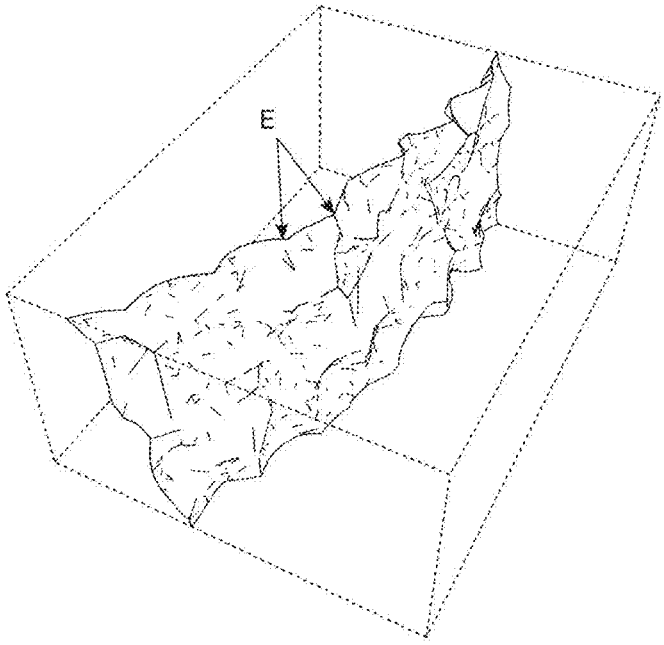
Figure 29:
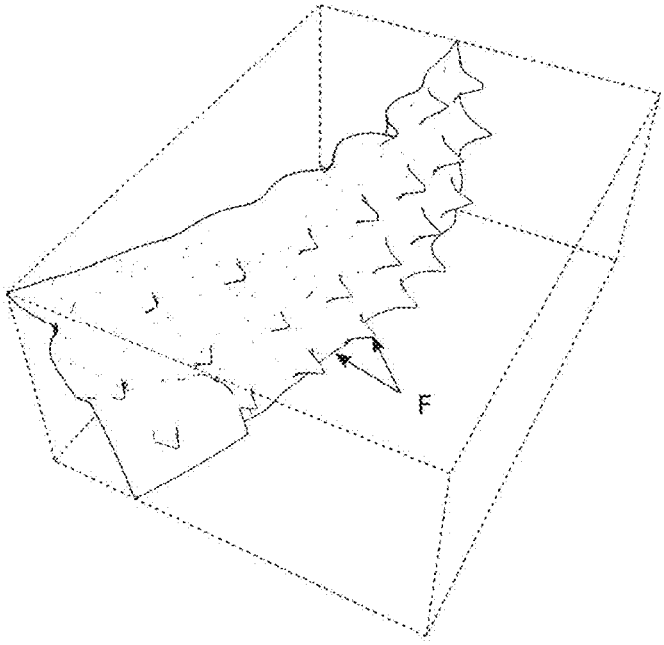

FIG. 12 shows a front portion of an example of helmet together with helmet section 1006 referenced in FIGS. 13-35. Phantom lines represent the portion of the box that would be hidden by the helmet exterior. The detail area chosen is representative of the construction of the entire helmet. FIG. 13 and FIG. 19 show all seven layers from two possible perspectives. Remaining FIGS. 20-35 illustrate layers peeled away from each perspective.

Part A is an outer coating made of a polymer compatible with the 3D printed material to which it is applied. It may vary in thickness and cosmetic qualities (e.g. color) facilitating customization. The coating may be of polyurethane or any other material that bonds directly to the 3D printed material. The material should provide complementary material properties (coefficient of expansion, strength, elongation) to the underlying material to avoid cracking. Resistance to heat and cold, resistance to abrasion and resistance to moisture are other considerations that vary by sport. The coating may reduce the friction of impact, facilitating rotation of the helmet relative to an impact surface without rotating the head, thereby reducing the probability of a concussion. Additional disclosure related to Part A may be found in the Surface Treatment section and/or the Polymer Shell section below.

In any example a 0.05 mm to 1 mm layer forms part A, and is sprayed in multiple coats to achieve the minimum thickness needed to smooth over defects on the surface of B such as 3D printing layer lines. The thickness needed may vary across the surface depending on the 3D printing process. The coating may be modified to hold any number of pigments, dyes, retardants, thickeners, modifiers or reinforcers such as carbon black, titanium dioxide, glass, fumed silica, graphene or fluoropolymers. The coating may be applied as an atomized spray, by brush, immersion, vapor deposition, or other conventional means. Solvents and adhesion promoters specific to the 3D printed material may be used. Materials cured by heat and/or ultraviolet light may be used.

Part A may be a different color than the 3D printed material to create an attractive appearance, represent team colors, etc. Regions of part A may be masked off, printed on, debossed, or a texture applied by using pressure or heat after 3D printing. Groove 1005 in FIGS. 10A, 10B and 12 are formed during 3D printing to position a mask used to restrict the application of A to desired areas.

The groove 1005 which runs alongside the bottom of the helmet, is between 1 and 4 mm thick and 1 and 12 mm deep allowing the insertion of a mask circumventing the entire helmet, or any portions that may be coated associated with Part A.

Furthermore, in this example the groove allows the insertion of an ear cup into groove 1005. The ear cup is held in place via a bulge in the ear cup that is press fit into a corresponding bulge in the groove. The ear cup itself may be used to hold and align helmet subcomponents as part of assembly.

Part B is a 3D printed 0.05 mm to 3 mm skin that determines the exterior shape to which part A is applied. It provides a substrate for Part A to flow over and form a smooth surface before A cures. For cosmetic reasons, there may be areas in the helmet where this is layer is absent to enable viewing the underlying layers. FIGS. 13, 18, 19 and 25 show parts A and B of a helmet. Additional disclosure related to Part A may be found in the Surface Treatment section and/or the Polymer Shell section below.

Figure 14:
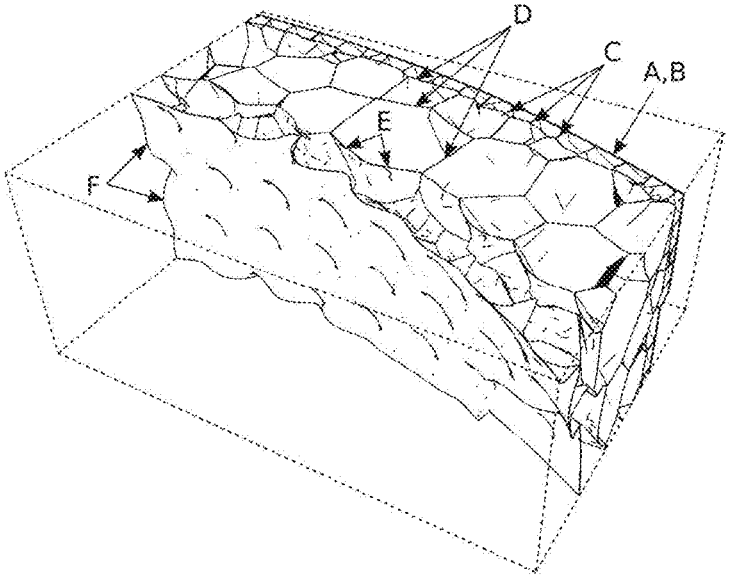

Part C supports part B and connects it to part D, providing enough rigidity to A during manufacture to avoid deformation. Additionally, the structure provides support while additive manufacturing part A and helps to stop tears. FIG. 14 shows a helmet example which may have a periodic 5 mm hex pattern with 0.2 to 0.8 mm walls oriented normally to the exterior in a honeycomb formation. FIGS. 17, 21, 26 and 31 show part C of the helmet.

3D printing produces different structural properties depending on orientation of a planar surface with respect to the print bed. In one case, a hexagonal infill is deliberately deformed or simply rotated to minimize the presence of horizontal surfaces. Orientation of printing planar surfaces relative to the print bed may be adjusted in order to vary structural properties of the helmet.

Part D is a structure which may be comprised of individually constructed gas-containing cells optimized to reduce linear and rotational acceleration for impacts expected for the sport, age and demographic of the user. It also serves to support part C during manufacture. FIGS. 16, 22, 27 and 32 show part D of the helmet. Additional disclosure related to Part D may be found in the Energy Management Layer Optimization section below.

Part D may have a closed cell structure and may be of spatially varying density. Cell walls may be oriented tangentially or varying angles to direct forces to reduce angular acceleration on impact, or oriented to facilitate additive manufacturing. The cell structure may be periodic. The cell structure may include surfaces that minimize surface area, weight and/or angle of wall intersection. The cell structure may be based on a Voronoi partition of space using points distributed to control density and orientation followed by computational optimization of material and bulk material characteristics such as density and viscoelasticity. The cell structure may be optimized to reduce acceleration during impact using finite element simulation. Some cells may be filled with air, a gas with preferred kinetic absorption such as argon, or a dilatant, shear thickening or energy-absorbing foam or fluid. Some cells walls may have small holes to allow shock absorption and pressure equalization.

Figure 15:
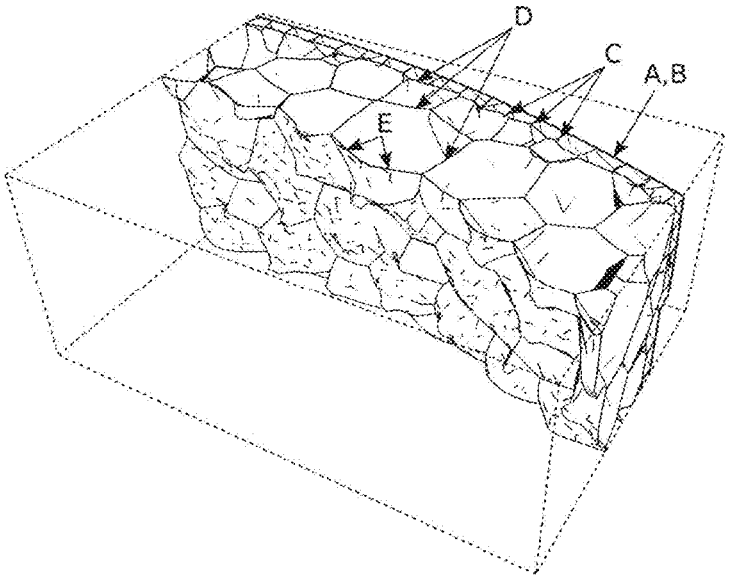
Figure 16:
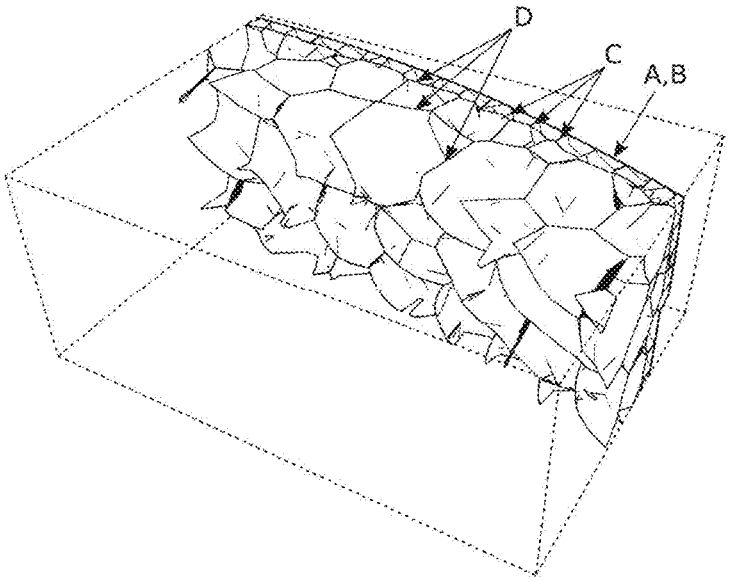
Figure 17:
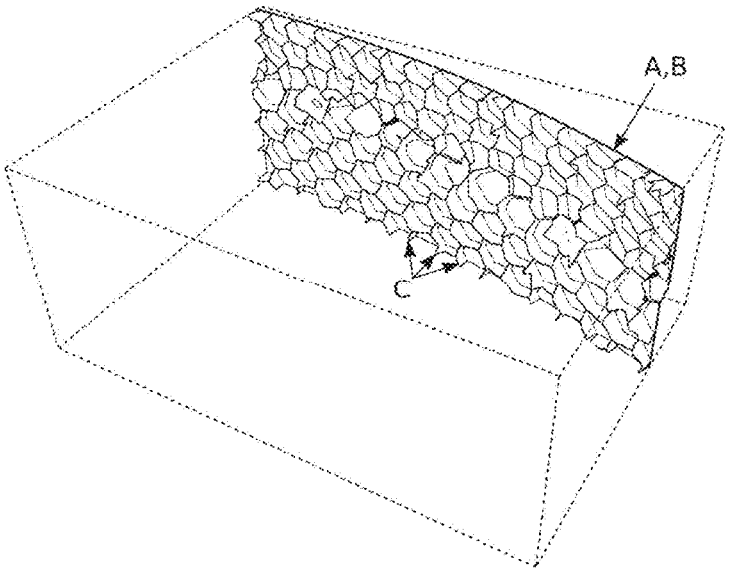
Figure 18:
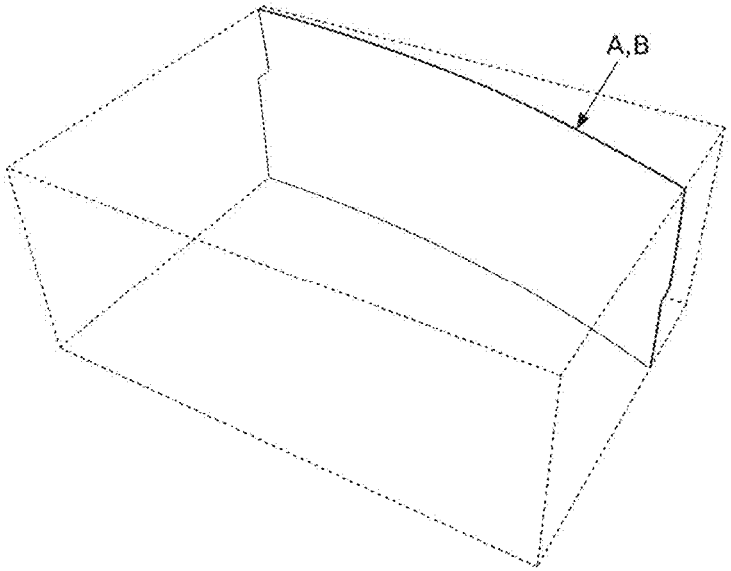

In any example of a helmet such as illustrated in FIG. 15, cell walls may be 0.2 to 8 mm and air filled. Cells may be denser farther from the head, at a density consistent with the 5 mm structure of part C, while increasing in size towards the wearer to be more conformal as the head is approached, growing up to 15 mm.

In any helmet example, infill may alternately be formed by Voronoi partitioning of the interior space of the helmet, with partitions designed to produce fine support surfaces that appear normal to the outside surface, and larger partitions occur on the inside. This allows more efficient use of material. The partitions may also be formed to minimize material following Plateau's laws of surface minimization, or by evolving the infill using the mathematical concept of mean curvature flow. The partitions may also be created by tetrahedralization of the exterior 3D mesh, mapping an arbitrary density function by means of the 3D analog of algorithms for generating cartograms, conformal projection of a grid, or other diffeomorphic techniques. This technique may be used to create infill with tetrahedralization with fine structure near and normal to the outside, and coarse structure closer to the head.

Part E may be a 0.2 to 0.8 mm wall that connects the closed cells of part D to the open cells forming comfort lining part F. It serves to support part D during manufacture and closes off cells, while supporting part F only at minimal periodic locations. This allows the comfort lining to remain compliant while remaining connected to part D. In this example or any example contact between E and F is established in 1 mm diameter regions spaced approximately 5.5 mm apart along a hexagonal grid. It may be farther optimized to minimize material needed while still connecting D and F. FIGS. 15, 23, 28 and 33 show part E of this example of helmet.

Part F is a lining suitable for sustained contact with the skin. It may be compliant with a shape and contour that is designed to match a shape and contour of a head. In areas not disposed against the skin part F may be flat surface that can be customized by debossing or otherwise modifying the 3D printed model, or customized afterward by conventional printing, pressure or heat techniques.

Any of the cells in the energy management layer, external shell, or any part of the helmet may be left open, infilled with material to partially or fully close the cell to create varying surfaces. This allows helmet compliance and comfort to be varied. Any of the quilting options disclosed herein may be used in any helmet.

Figure 40:
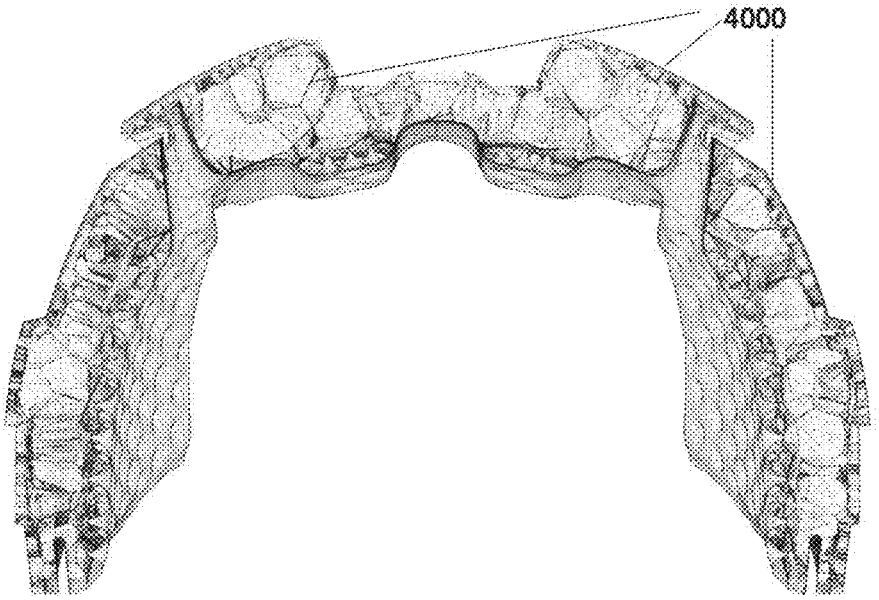
FIG. 40 shows hexes normal to a user's head.

The quilting algorithm that may exploit the presence of infill to minimize material or maximize comfort. In one case, the outer pillows correspond to the hexagonal pattern where infill meets the exterior. In another case, the outer pillows follow the contours of a minimal periodic or fractal infill. In another case, the infill is designed to present a fractal or maze-like contour on the surface. In another case, there is no infill and the surface is shaped to provide comfort, such as with a periodic pattern of exterior curves presenting a majority smooth surface to the head. The trade-off between compliance and comfort and safety can thus be managed by controlling whether air can flow between cells, is closed to a cell, or can partially flow. FIG. 40 illustrates this concept where hexes 4000 are normal to the surface of the head.

One example has material facing the head with toroidal geometry that is periodic on the 2D manifold of the head, such that the surface is locally nearly minimal and perceptibly soft, constrained only by the connection to infill that occurs within each "donut hole".

Interior quilting may be formed by negatively curved toroidal cushions on a triangular grid or by positively curved cushions on a hexagonal grid.

FIGS. 14, 24, 29 and 34 show the example of helmet with part F. It is a surface in which the surface touching the skin may be everywhere smooth. Contact with part E is only at small evenly distributed points, isolating the skin from the internal structure of part E. The surface around these points of contact with part E have a negative Gaussian curvature (e.g. toroidal) to allow printability: areas horizontal to the print bed and therefore unsupported by the previously printed layers occur only in small and well distributed positions. The open structure allows increased compliance and air movement to transfer body heat. In this example the printed wall is 0.5 mm, the overall depth of this layer is 5 mm, with contact to part E established in 1 mm diameter regions spaced approximately 5.5 mm apart along a hexagonal grid. These dimensions as well as others disclosed herein are not intended to be limiting and are only examples.

Part G is specialized material such as foam applied at key points of contact with the skin to provide specific properties such as increased compliance, sweat wicking, and personalized print or deboss. The surface of this material may be customized for the user using conventional pigment, pressure, or heat techniques.

Figure 30:
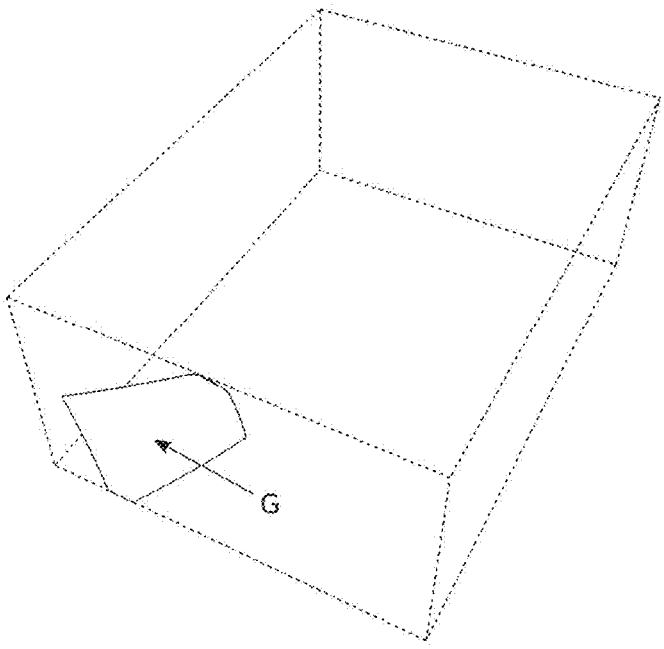
Figure 31:
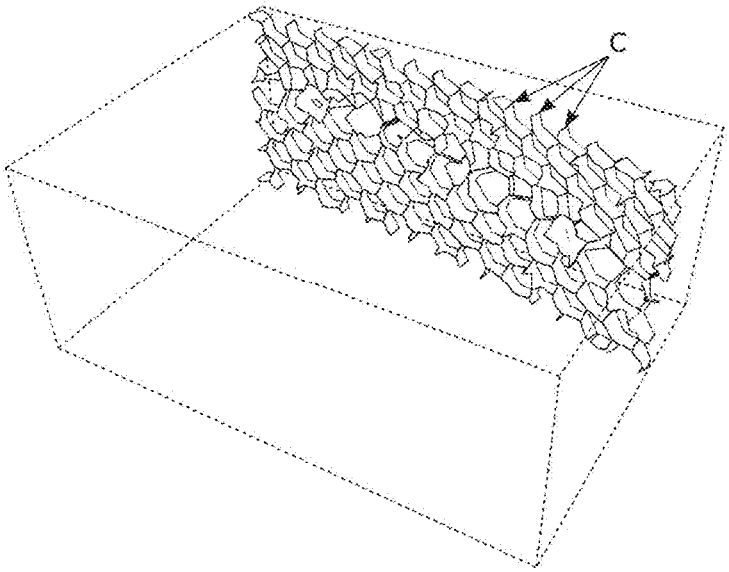
Figure 32:
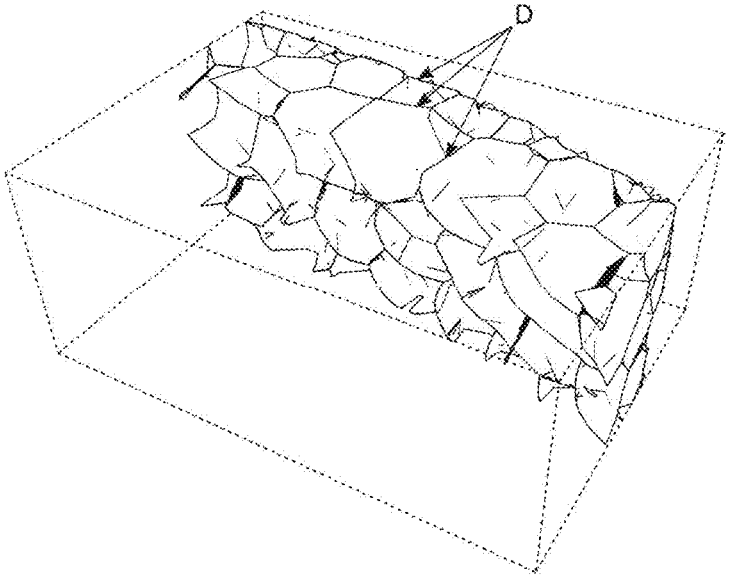
Figure 33:
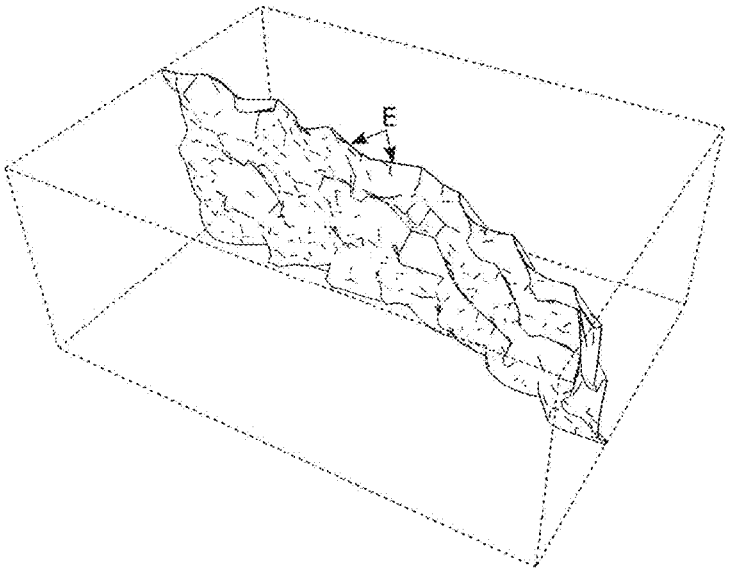
Figure 34:
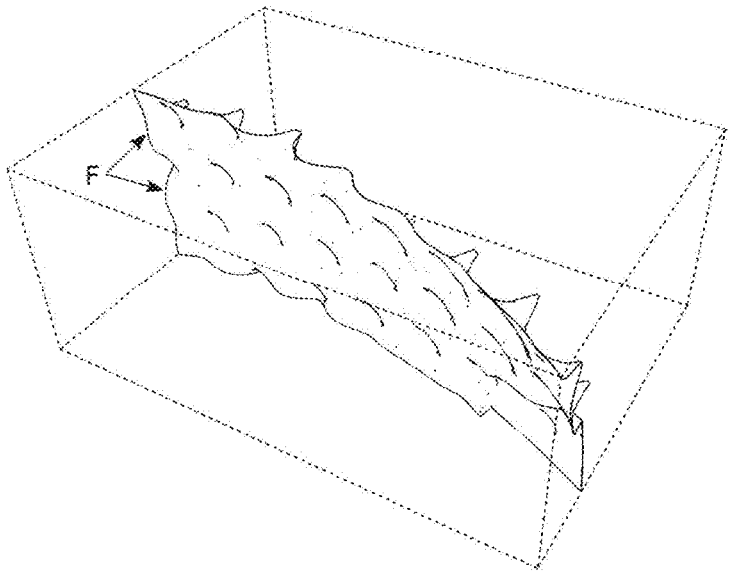
Figure 35:
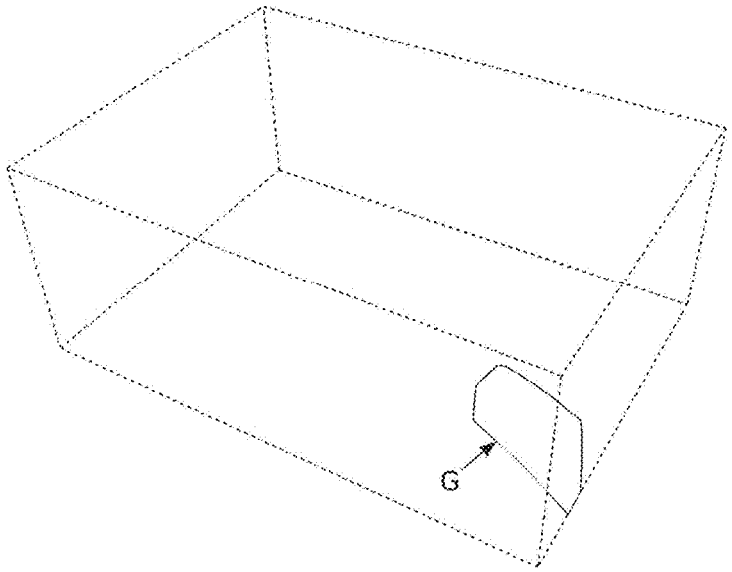

FIGS. 13, 30 and 35 show part G in an example. The depth of G is 3 mm, but where it is applied to part F, 2 mm is recessed to provide a flat adhesion surface as seen in FIGS. 14 and 34, resulting in the foam surface that contacts skin being 1 mm above the 3D printed layer. Optionally a plurality of outwardly extending dimples may be used to contact the skin/head surface.

In any example the foam may be a laser-cut closed-cell ethylene-vinyl acetate with a pressure-sensitive adhesive backing. Any material could be substituted, including non-foam materials such as fabric, injection-molded foams, materials designed to reduce skin friction such as fluoropolymers, and combinations of these. Any bonding system could be substituted including solvent welding, heat welding, ultrasonic welding, or chemical, heat or UV curing polymers.

Any of the layers may have the same or different densities and geometries relative to adjacent or other layers in the helmet. Additionally, some or all of the layers may be integral with one another. Therefore, in one example, a plurality of layers are integrally formed together with varying densities in at least some of the layers.

Surface Treatments

It is generally accepted that reducing angular accelerations on the head reduces the probability of concussions as previously discussed above. Some attention has been made on making the inside of the helmet slip against the scalp so that the helmet, rather than the head, rotates upon impact. This has severe limitations as the head and helmet are not perfectly spherical, so motion is limited. Instead, the application of surface treatments to the exterior of the helmet facilitate the same sliding on the exterior surface. This surface treatment is particularly applicable to hockey where the impact surfaces tend to be smooth surfaces (glass, ice, other players) versus something like cycling where the pavement induces a high coefficient friction regardless of the helmet surface. Helmet surface bumpiness, materials, coatings, may be adjusted to control the surface. Also use of graphene, nanomaterials or other materials may be used in the helmet coatings to facilitate helmet sliding relative to a surface.

In addition to surface treatments to improve safety, there are also specialized processes that may be used for the preparation and mass production of the helmet, including cleaning, priming, sanding, using various polymers or epoxies, as well as heating, vacuuming, silica, antigravity processes.

Powder coatings and paints may help provide a desired surface. Also a single continuous extrusion with internal support using convolved/simplified space filling curve may be beneficial.

Polymer Shell.

Commercially available helmets typically have an outer plastic shell which has been injection molded. A foam energy management layer is then attached to the outer shell. Injection molded helmets typically tape, glue or directly mold the foam energy management layer onto a plastic shell. FIG. 39 illustrates various layers of a helmet as previously discussed, including shell 3900, energy management layer 3901, stand-off 3902, and comfort liner 3903.

This requires extensive tooling for the shell and foam and additional tooling and expense to directly mold foam into plastic. This can be cumbersome and costly process.

Improved processes which may be used in any of the examples of helmets disclosed herein allow a polymer shell to be applied directly and/or integrally to the energy management layer in a manner similar to painting where the polymer layer is applied like paint such as by brushing, rolling, spraying, etc. the polymer onto the energy management layer. The process also has the benefit of varying the shell thickness and cosmetic qualities (e.g. color) facilitating customization.

Examples of headgear disclosed herein may include a polymer-based shell that is applied directly and integrally to the energy management layer with the same benefits of paint (see manufacturing section for more details.) The shell itself provides at least some of the following benefits:

- Allows the creation of a thin, yet durable surface that adds rigidity compared to the underlying energy management system alone.
- Enables different colors through dyes in the polymer itself or by painting on top of a shell (such as an epoxy-based shell) thereby allowing further customization/personalization based on personal preference.
- Not only diffuses impact forces over a broader area, but also, in conjunction with the underlying energy management layer, attenuates impact forces lowering the peak accelerations experienced by the user's head reducing the risk of head trauma.
- Provides the opportunity to apply low friction coatings which reduce the coefficient of friction, thereby reducing forces and the associated angular accelerations that would otherwise be imparted on the head.

Energy Management Layer Optimization

The vast majority of helmets utilize foam to mitigate impact forces to the head. These foams include EPP, EPS and Vinyl Nitrate in a variety of commercially available densities. Foam may have some of the following shortcomings—their availability in fixed densities and the testing standards are such that helmets typically only come in the highest densities to pass certification but are not appropriate for minimizing concussions or optimized for energy dissipation.

Use of alternative materials and structural geometries of the energy management layer enhance the performance of the energy management layer. For example, a variable density energy management layer formed from mapping diffeomorphisms can result in a series of modified hexagonally shaped cells is proven to be a more effective energy management layer. The energy management layer may be disposed in a number of different orientations with isotropic or anisotropic properties and can vary in density and infill throughout the structure. Any of the helmets disclosed herein may include any of the energy management layers disclosed herein.

Examples of the present helmets may utilize materials and developed shapes (such as modified hexagon) optimized for density, energy attenuation and manufacturability. The result may include the following layers having geometries hat may be or have:

- Normal to headform.
- Oblique to headform to optimize rotational concerns and competitive with expanded foams.
- Vertical hex alignment for printability.
- Triply periodic minimal surfaces, such as Schwarz's gyroid.
- Placement of air cavities.
- Use of FEA in processing.
- Testing feedback.
- Softer areas next to scalp.
- Ability to handle repeated hits with less degradation.
- Filling between personalized headform and outer shell with guaranteed setbacks.
- Variable density and orientation by mapping diffeomorphisms e.g. a conformal map.

An aspect of examples of headgear using the techniques disclosed herein is the use of variable density and orientation by mapping diffeomorphisms. This approach can map any shape (e.g. a hex) to a selected surface (e.g. the outer surface of the helmet) and continue to project it down into a headform. The mapping process morphs the original shape to fit onto the mapped surface such that the walls forming the hex will no longer form 60 degree angles, the typical angle between adjacent walls in a hex, with each other. The use of a hex is due to its high volume to surface area ratio as a result of a minimizing tessellation algorithm, but any shape or form can be used as part of mapping diffeomorphisms. The resulting output has several key properties, including those discussed below.

Minimizing here means low wall material to volume ratios at or below 15% are feasible, which reduces material usage, weight and print times. Therefore, the ability to have densities approaching that of the foams commonly found in traditional helmets. Assuming the polymer used has a density between 0.75 to 1.25 g/cm^3, the resulting energy management can have densities below 0.25 g/cm^3 and up to the density of the underlying material.

Geometries that are printable on FDM printers without supports. Specifically, that angles from the vertical of 65 degrees or less or overhangs <15 mm across which facilitate bridging.

Desirable energy attenuation properties both in direct impacts and in having favorable shearing properties to reduce angular accelerations to the head.

The smooth transition and optimization for continuous lines between walls, facilitating printing by minimizing start, stops and retractions and material integrity.

Furthermore, it is possible to support variable density infills, where a pattern can transition to a lower or higher density version of the same or different pattern either in the normal direction to the helmet, or across the surface (e.g. transitioning from the front to the side of the helmet). The seamless transition between lower and higher density regions within the energy management layer provide the following benefits:

A softer region against the head is typically more forgiving and comfortable for the wearer and may obviate the complexity and offset requirements of an additional comfort liner.

A very dense region near the outer surface of the helmet further distributes the impact forces over a broader area, complementing any existing hard shell or hard shell like surface.

Optimal impact attenuation for a given weight

Finally, it is possible to reorient the patterns, hexes in this example, to be transverse along the head instead of normal (as seen in FIG. 40) to optimize for particular impact scenarios.

Digital Manufacturing and Mass Personalization.

Using some or all of the techniques disclosed herein allow the helmets to be personalized to match the user's head more precisely thereby providing a more comfortable helmet and a safer helmet. Personalization also allows a wearer's preferences to be incorporated into the helmet such as with respect to color and other optional ornamental features. Inside-out manufacturing techniques also facilitate the production of a personalized helmet where the energy management layer is produced and the outer polymer shell layer is added on top in a sequential manner. An optional comfort liner, either personalized or a standard liner may be added to the energy management layer. It may be a fixed width liner that is added in order to conform to variances in the head that may be too small to detect with photos or 3D scanners.

The following outlines examples of processes and algorithms for enabling mass personalization via a platform that digitizes the customizable inputs (e.g. sizes, customer parameters, etc.) and feeds them into a on demand manufacturing platform (for example 3D printers).

Helmet Personalization

There are various approaches to support personalization of helmets including but not limited to considering one or more of the following factors, any of which may be employed in any helmet:

Sizing Personalization using a video/photo/3D with skull cap, manual, and constant force based cephalometry.

Using a logo on skull cap also for stereometry.

Personalization of energy management layer using gender, age, sport, weight, height as well as cephalometry.

Update Recommendation based on growth curve or and AI techniques from data.

Cosmetic personalization using text, signature, logo embossed directly onto the helmet.

Sizing Personalization

One example of the above is to use images taken from a smartphone (or other photography device) of a person wearing a well-defined beanie, hat, swim cap or any other accessory that uniformly mats down the head hair. Specifically, the beanie normalizes for different hair types that would otherwise make image processing and measurement difficult and the beanie includes one or more shapes, symbols or text of known dimensions and orientation. In the case of the beanie, a log of known width, height and having known line thicknesses can be used. With this information a photo can be normalized for photos taken off angle (i.e. skewed) and distances are scaled with the logo to determine the width, height, length and other key metrics of the head. Likewise, the beanie is of a known thickness and the fabric stretching is determined iteratively based on the initial estimate of head size, rather than utilizing the initial size to estimate fabric stretch, and so on and therefore the thickness of fabric can be easily subtracted from any measurements. The minimum number of photos required is a front view and side view to get an aspect ratio of width and length of the head. Ideally an additional side and rear photo is taken to confirm measurements or request re-shots if necessary. The addition of a horizontal trim of a different color on the beanie adds another visual calibration element to verify the beanie is worn consistently (e.g. level).

Figure 41:
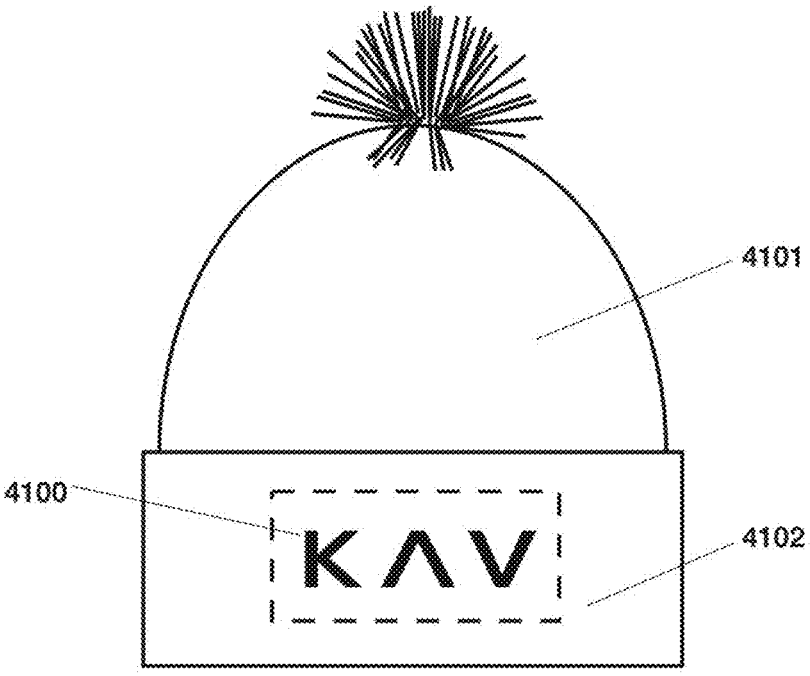
FIG. 41 shows a beanie hat which may be used for calibration and personalization.

FIG. 41 shows an example of a cap that may be used during the calibration cap process where the logo 4100 may be used for calibration and the top color 4101 and the bottom color 4102 may be disposed.

Additional inputs to the algorithm may include gender, age, weight and height to anticipate growth and optimize the sizing for current and future use (e.g. safe usage in the present while accommodating 12-24 months of growth).

The benefits of this technique versus others may include accounting for hair in a consistent and normalized fashion, as well as other benefits.

The use of a logo, indicia or other calibration method provides a degree of precision not otherwise available when using smart phones or other cameras with inaccurate focal distance measurements, lens distortion and other variables that make measurement extrapolation error prone and imprecise.

Notes and Examples

The following, non-limiting examples, detail certain aspects of the present subject matter to solve the challenges and provide the benefits discussed herein, among others.

Example 1 is a helmet configured to be worn on a head of a wearer, the head having a shape and a contour, said helmet comprising: a plurality of layers coupled together including an energy management layer and an outer shell layer disposed over the energy management layer, wherein the plurality of layers are integrally formed with one another, wherein the energy management layer is configured to absorb and dissipate energy received by the helmet during an impact by an external force, wherein the outer shell layer is configured to disperse and dissipate impact energy from the external force, and wherein each of the plurality of layers has a density and a geometry, and wherein the density or the geometry of at least one layer differs from the density or the geometry of at least another layer.

Example 2 is the helmet of Example 1, wherein the energy management layer comprises an inner surface with a shape and a contour, and wherein the shape and the contour of the energy management layer is personalized to match the shape and contour of the head.

Example 3 is the helmet of any of Examples 1-2, wherein the density of the shell layer is greater than the density of the energy management layer.

Example 4 is the helmet of any of Examples 1-3, further comprising a cage releasably coupled to the helmet.

Example 5 is the helmet of any of Examples 1-4, wherein the cage comprises a plurality of substantially vertical wires and a plurality of substantially horizontal wires coupled together to form a grid, wherein the plurality of substantially vertical wires have a superior end, an inferior end, and an intermediate portion therebetween, wherein the superior end and the inferior ends are disposed outside of the plurality of substantially horizontal wires, and wherein the intermediate portion is disposed inside of the plurality of substantially horizontal wires, thereby forming a low profile cage.

Example 6 is the helmet of any of Examples 1-5, wherein the cage comprises a point disposed furthest away from a nose of the wearer, and wherein the point is 20 mm to 35 mm away from the nose thereby forming a low profile cage.

Example 7 is the helmet of any of Examples 1-6, further comprising a clip integrally formed with the outer shell layer and coupled to the outer shell layer and the cage, wherein the clip comprises a lever arm, and wherein actuation of the lever arm allows engagement and disengagement of the cage with the clip.

Example 8 is the helmet of any of Examples 1-7, further comprising an inner comfort layer configured to be disposed against the head, the inner comfort layer having a density less than the energy management layer or the inner comfort layer being softer than the energy management layer.

Example 9 is the helmet of any of Examples 1-8, wherein the density of at least some of the plurality of layers varies from a front of the head to a back of the head, from a side of the head to an opposite side of the head, or in a direction extending radially outward and away from the head.

Example 10 is the helmet of any of Examples 1-9, further comprising an occipital cushion configured to cushion an occipital region of the head or configured to accommodate variances in fit between the helmet and the head, the occipital cushion being adjustable or removably coupled to an occipital region of the helmet.

Example 11 is the helmet of any of Examples 1-10, further comprising one or more sweat gutters disposed on an inner surface of the helmet and configured to direct beads of sweat away from eyes of the wearer.

Example 12 is the helmet of any of Examples 1-11, wherein the plurality of layers is formed into a plurality of portions, the plurality of portions joined together with pins, biscuits or dovetail joints.

Example 13 is the helmet of any of Examples 1-12, wherein the plurality of layers comprise a coating disposed over the outer shell layer.

Example 14 is the helmet of any of Examples 1-13, wherein the plurality of layers comprises a support layer adjacent the outer shell layer, the support layer configured to support the outer shell layer and prevent deformation thereof during manufacturing.

Example 15 is the helmet of any of Examples 1-14, wherein the energy management layer comprises a plurality of gas containing closed cells.

Example 16 is the helmet of any of Examples 1-15, wherein the plurality of layers comprises a support layer adjacent the energy management layer, the support layer configured to support the energy management layer.

Example 17 is the helmet of any of Examples 1-16, wherein the plurality of layers comprise a lining under the energy management layer, wherein the lining is configured for sustained contact with the head.

Example 18 is the helmet of any of Examples 1-17, wherein the plurality of layers comprise a foam layer extending outwardly toward the head.

Example 19 is a method for fabricating a helmet configured to be worn on a head of a wearer, the head having a shape and a contour, said method comprising: integrally forming a plurality of layers disposed on top of one another, the plurality of layers comprising an energy management layer and an outer shell layer, wherein the energy management layer comprises a first density and geometry and has an inner surface with a shape and a contour, the energy management layer configured to absorb and dissipate energy received by the helmet when impacted by an external force, and wherein the outer shell layer is disposed over the energy management layer, the outer shell layer having a second density or a second geometry different than the first density or first geometry, wherein the outer shell layer is configured to disperse and dissipate impact energy from the external force.

Example 20 is the method of Example 19, further comprising releasably coupling a cage to the outer shell layer with clips integrally formed with the outer shell layer.

Example 21 is the method of any of Examples 19-20, further comprising forming the cage with a plurality of substantially vertical wires and a plurality of substantially horizontal wires coupled together to form a grid, wherein the plurality of substantially vertical wires have a superior end, an inferior end, and an intermediate portion therebetween, wherein the superior end and the inferior end are disposed outside of the plurality of substantially horizontal wires, and wherein the intermediate portion is disposed inside of the plurality of substantially horizontal wires, thereby forming a low profile cage.

Example 22 is the method of any of Examples 19-21, further comprising personalizing the shape and contour of the energy management layer to match the shape and contour of the head.

Example 23 is the method of any of Examples 19-22, further comprising applying a coating to the outer shell layer.

Example 24 is the method of any of Examples 19-23, wherein integrally forming the plurality of layers comprises forming a support layer adjacent the outer shell layer, the support layer configured to support the outer shell layer and prevent deformation thereof during manufacturing.

Example 25 is the method of any of Examples 19-24, wherein integrally forming the plurality of layers comprises forming a plurality of gas containing closed cells in the energy management layer.

Example 26 is the method of any of Examples 19-25, wherein integrally forming the plurality of layers comprises forming a support layer adjacent the energy management layer, the support layer configured to support the energy management layer.

Example 27 is the method of any of Examples 19-26, wherein integrally forming the plurality of layers comprises forming a lining under the energy management layer, wherein the lining is configured for sustained contact with the head.

Example 28 is the method of any of Examples 19-27, wherein integrally forming the plurality of layers comprises forming a foam layer extending outwardly toward the head.

Example 29 is the method of any of Examples 19-28, further comprising forming an inner comfort layer having an inner surface with a shape and a contour, the inner comfort layer abutting the energy management layer and comprising a material softer or less dense than the energy management layer.

Example 30 is the method of any of Examples 19-29, wherein forming the plurality of layers comprises forming the plurality of layers with a varying density or a varying pattern.

Example 31 is the method of any of Examples 19-30, wherein varying the density or varying the pattern comprises varying the density or varying the pattern from a front of the head to a back of the head, from a side of the head to an opposite side of the head, or extending radially outward and away from the head.

Example 32 is the method of any of Examples 19-31, further comprising releasably or adjustably coupling an occipital cushion to the outer shell or the energy management layer.

Example 33 is the method of any of Examples 19-32, further comprising heating the helmet and shaping at least a portion of the helmet to match the shape and the contour of the wearer's head.

Example 34 is the method of any of Examples 19-33, further comprising integrally forming one or more sweat gutters on an inner surface of the helmet.

Example 35 is the method of any of Examples 19-34, wherein forming the plurality of layers comprises forming at least some of the plurality of layers with additive manufacturing.

Example 36 is the method of any of Examples 19-35, wherein the plurality of layers are formed into a plurality of portions, the method further comprising joining the plurality of portions together with pins, biscuits, or dovetail joints.

Example 37 is the method of any of Examples 19-36, further comprising personalizing or customizing the helmet to include features unique to the wearer.

Example 38 is a helmet cage clip comprising an elongate arm; a tunnel adjacent one end of the elongate arm, the tunnel sized and shaped to receive and hold a wire of a helmet cage; a ramp adjacent the tunnel and configured to urge the wire of the helmet cage into the tunnel, wherein actuation of the elongate arm opens a side of the tunnel to receive the wire helmet cage, and wherein the elongate arm is biased to return to a neutral position where the side of the tunnel is substantially closed and configured to hold the wire of the helmet cage.

Example 39 is a helmet comprising: an outer shell layer and an energy management layer; and an occipital cushion releasably or adjustably coupled to the energy management layer, wherein the occipital cushion is configured to cushion or accommodate variances in fit in an occipital region of a wearer's head.

Example 40 is a helmet comprising: an outer shell layer and an energy management layer; and a sweat gutter integrally formed on an inner surface of the helmet, the sweat gutter configured to direct beads of sweat away from eyes of a wearer.

Example 41 is a method for fabricating a helmet configured to be worn on a head of a wearer, the head having a shape and a contour, the method comprising: providing a helmet having a plurality of layers integrally formed with one another, the plurality of layers comprising an energy management layer and an outer shell layer, wherein the energy management layer comprises an inner surface with a shape and a contour; and heating the helmet and forming the shape and contour of the energy management layer to match the shape and the contour of the wearer's head.

In Example 42, the apparatuses or methods of any one or any combination of Examples 1-41 can optionally be configured such that all elements or options recited are available to use or select from.

Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein. Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein. Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The invention claimed is:

1. A helmet configured to be worn on a head of a wearer, the head having a shape and a contour, said helmet comprising:

a plurality of layers coupled together including an energy management layer and an outer shell layer disposed over the energy management layer, wherein the energy management layer comprises an integral structure formed by additive manufacturing and comprising closed cells, in which a size of the closed cells varies spatially within the helmet to absorb and dissipate energy received by the helmet during an impact by an external force, the size of the closed cells being smaller closer to the outer shell layer and larger further from the outer shell layer, wherein the size of the closed cells forming the integral structure are formed in a pattern that is the same shape and varies in the size from a front to a back of the helmet or from a side to side of the helmet, wherein the outer shell layer is configured to disperse and dissipate impact energy from the external force, and wherein each of the plurality of layers has a density and a geometry, and wherein the density or the geometry of at least one layer differs from the density or the geometry of at least another layer.

2. The helmet of claim 1, wherein the energy management layer comprises an inner surface with a shape and a contour, and wherein the shape and the contour of the energy management layer is personalized to match the shape and contour of the head.

3. The helmet of claim 1, wherein walls of the closed cells forming the integral structure comprises a hexagon or modified hexagon pattern oriented normally to an outer surface of the helmet.

4. The helmet of claim 1, wherein the closed cells forming the integral structure comprises triply periodic minimal surfaces.

5. The helmet of claim 1, wherein walls of the closed cells forming the integral structure comprises a hexagon or modified hexagon pattern oriented vertically.

6. The helmet of claim 1, further comprising an inner comfort layer configured to be disposed against the head, the inner comfort layer having a density less than the energy management layer or the inner comfort layer being softer than the energy management layer.

7. The helmet of claim 1, further comprising an occipital cushion configured to cushion an occipital region of the head or configured to accommodate variances in fit between the helmet and the head, the occipital cushion being adjustable or removably coupled to an occipital region of the helmet.

8. The helmet of claim 1, further comprising one or more sweat gutters disposed on an inner surface of the helmet and configured to direct beads of sweat away from eyes of the wearer.

9. The helmet of claim 1, wherein the plurality of layers are formed into a plurality of portions, the plurality of portions joined together with pins, biscuits or dovetail joints.

10. The helmet of claim 1, further comprising a polymer coating disposed over the outer shell layer.

* * * * *